US010281173B2

(12) United States Patent
Naitoh et al.

(10) Patent No.: US 10,281,173 B2
(45) Date of Patent: May 7, 2019

(54) BURNER, COMBUSTION APPARATUS, METHOD FOR COMBUSTION, METHOD FOR CONTROLLING COMBUSTION, RECORDING MEDIUM, AND WATER HEATER

(71) Applicant: PURPOSE CO., LTD., Fuji-shi, Shizuoka (JP)

(72) Inventors: Katsumi Naitoh, Fuji (JP); Yasunori Katoh, Fuji (JP); Jun Aiso, Fuji (JP); Kentaro Suzuki, Fuji (JP)

(73) Assignee: PURPOSE CO., LTD., Fuji-shi (JP)

( * ) Notice: Subject to any disclaimer, the term of this patent is extended or adjusted under 35 U.S.C. 154(b) by 440 days.

(21) Appl. No.: 13/923,479

(22) Filed: Jun. 21, 2013

(65) Prior Publication Data

US 2014/0000534 A1 Jan. 2, 2014

(30) Foreign Application Priority Data

Jun. 28, 2012 (JP) ..... 2012-145364
Jun. 28, 2012 (JP) ..... 2012-145365
Jun. 28, 2012 (JP) ..... 2012-145366

(51) Int. Cl.
*F24H 9/20* (2006.01)
*F23D 14/14* (2006.01)
(Continued)

(52) U.S. Cl.
CPC ..... *F24H 9/2035* (2013.01); *F23D 14/02* (2013.01); *F23D 14/045* (2013.01);
(Continued)

(58) Field of Classification Search
CPC ..... F23D 14/02; F23D 14/045; F23D 14/145; F23D 2900/00019; F23D 14/70;
(Continued)

(56) References Cited

U.S. PATENT DOCUMENTS 4,480,988 A 11/1984 Okabayashi et al.
4,504,218 A * 3/1985 Mihara ..... C04B 35/803 431/326
(Continued)

FOREIGN PATENT DOCUMENTS

EP 0 488 481 A1 6/1992
JP S48-004427 U 6/1971
(Continued)

OTHER PUBLICATIONS

Information Offer Form submitted on Dec. 4, 2015 to corresponding Japanese Patent Application No. 2012-145364, with Outbound Manifest, issued Dec. 15, 2015, with English translation of relevant portions (14 pages).
(Continued)

*Primary Examiner* — Steven B McAllister
*Assistant Examiner* — Benjamin W Johnson
(74) *Attorney, Agent, or Firm* — Westerman, Hattori, Daniels & Adrian, LLP

(57) ABSTRACT

High intensity combustion and low intensity combustion are carried out together, to stabilize flames and to hold down the emission of carbon monoxide. An air-fuel mixture outlet member (back plate) that includes a single or a plurality of outlet(s) (air-fuel mixture outlet(s)) out of which an air-fuel mixture (GA) flows is included, and a metal fiber knitting body (metal knit) that covers the air-fuel mixture outlet member is included. Therefore, the air-fuel mixture, which is made to flow out of the outlet(s), passes through the metal fiber knitting body (metal knit) and is combusted, a flame of low intensity is generated together with a flame of high intensity by combustion of the air-fuel mixture, and the flame of low intensity holds the flame of high intensity.

7 Claims, 32 Drawing Sheets

(51) Int. Cl.

| | |
|---|---|
| ***F24H 1/18*** | (2006.01) |
| ***F23D 14/02*** | (2006.01) |
| ***F23D 14/04*** | (2006.01) |
| ***F23D 14/70*** | (2006.01) |
| ***F24H 9/14*** | (2006.01) |
| ***F24H 9/18*** | (2006.01) |

(52) U.S. Cl.
CPC ..... *F23D 14/145* (2013.01); *F23D 14/70* (2013.01); *F24H 1/186* (2013.01); *F24H 9/14* (2013.01); *F24H 9/1836* (2013.01); *F23D 2203/103* (2013.01); *F23D 2203/1017* (2013.01); *F23D 2209/20* (2013.01); *F23D 2212/201* (2013.01); *F23D 2900/00019* (2013.01)

(58) Field of Classification Search
CPC ..... F23D 2203/1017; F23D 2203/103; F23D 2209/20; F23D 2212/201; F24H 1/186; F24H 9/14; F24H 9/1836; F24H 9/2035
USPC ..... 122/14.21, 17.1; 126/350.1
See application file for complete search history.

(56) References Cited

U.S. PATENT DOCUMENTS

| | | | | | |
|---|---|---|---|---|---|
| 5,248,255 | A | * | 9/1993 | Morioka | F27B 9/2407 431/326 |
| 5,360,490 | A | * | 11/1994 | Nelson | F23D 14/12 136/253 |
| 5,423,675 | A | | 6/1995 | Kratsch | |
| 5,989,015 | A | * | 11/1999 | Guerin | F23D 14/02 239/555 |
| 2004/0126727 | A1 | | 7/2004 | Cho et al. | |
| 2006/0040224 | A1 | | 2/2006 | Lovato et al. | |
| 2008/0145806 | A1 | | 6/2008 | Ojiro et al. | |
| 2010/0316967 | A1 | * | 12/2010 | Scribano | F23D 14/14 431/329 |

FOREIGN PATENT DOCUMENTS

| | | | | |
|---|---|---|---|---|
| JP | S48-004427 | U | | 1/1973 |
| JP | S48-008651 | B | | 3/1973 |
| JP | S56-153737 | U | | 11/1981 |
| JP | S57-071927 | U | | 5/1982 |
| JP | S58-175335 | U | | 11/1983 |
| JP | S62-107221 | U | | 7/1987 |
| JP | S62-190310 | A | | 8/1987 |
| JP | S63-217120 | A | | 9/1988 |
| JP | S63-217120 | A | | 9/1989 |
| JP | H02-052914 | A | | 2/1990 |
| JP | H03-263502 | A | | 11/1991 |
| JP | 8-35621 | A | | 2/1996 |
| JP | 11-248150 | | | 9/1999 |
| JP | 2000-146127 | A | | 5/2000 |
| JP | 2000146127 | A | * | 5/2000 |
| JP | 2000-249427 | A | | 9/2000 |
| JP | 2001-041421 | A | | 2/2001 |
| JP | 2001-235117 | A | | 8/2001 |
| JP | 2001235117 | | * | 8/2001 |
| JP | 2002-31308 | A | | 1/2002 |
| JP | 2002-031333 | A | | 1/2002 |
| JP | 2004-144468 | A | | 5/2004 |
| JP | 2005-143571 | A | | 6/2005 |
| JP | 2008-151362 | A | | 7/2008 |
| JP | 2010-60149 | A | | 3/2010 |
| JP | 2011-58746 | A | | 3/2011 |
| JP | 2012-021678 | A | | 2/2012 |
| JP | 2012-065731 | A | | 4/2012 |

OTHER PUBLICATIONS

English translation of JP2001-232117A dated Aug. 31, 2001. See paragraphs 0010-0011 and Figs. 1-3. (10 pages).
Office Action dated Jan. 26, 2016, issued in Japanese Patent Application No. 2012-145364, with Partial English translation. (8 pages).
Office Action dated Mar. 1, 2016, issued in Japanese Patent Application No. 2012-145365, with Partial English translation. (10 pages).
Office Action dated Mar. 1, 2016, issued in Japanese Patent Application No. 2012-145366, with Partial English translation. (10 pages).
English translation of JP2001-235117A dated Aug. 31, 2001. See paragraphs 0010-0011 and Figs. 1-3. (6 pages).
Office Action dated May 31, 2016, issued in counterpart Japanese Application No. 2012-145364, with partial English translation (7 pages).
Office Action dated Jul. 5, 2016, issued in counterpart Japanese Application No. 2012-145365, with English machine translation (10 pages).
Office Action dated Jul. 5, 2016, issued in counterpart Japanese Application No. 2012-145366, with partial English translation (10 pages).
Partial English Translation of Japanese Patent 2001-235117 A dated Aug. 31, 2001 (3 pages).
Partial English Translation of Japanese Patent S58-175335 U dated Nov. 24, 1983 (1 page).

* cited by examiner

BURNER, COMBUSTION APPARATUS, METHOD FOR COMBUSTION, METHOD FOR CONTROLLING COMBUSTION, RECORDING MEDIUM, AND WATER HEATER

CROSS-REFERENCE TO RELATED APPLICATIONS

This application is entitled to the benefit of priority of Japanese Patent Application No. 2012-145364, filed on Jun. 28, 2012, Japanese Patent Application No. 2012-145365, filed on Jun. 28, 2012, and Japanese Patent Application No. 2012-145366, filed on Jun. 28, 2012, the contents of which are hereby incorporated by reference.

BACKGROUND OF THE INVENTION i) Field of the Invention

The present invention relates to burners and combustion apparatuses that are used for heat sources of water heaters etc., and for example, relates to burners, methods for combustion and water heaters that use metal knits, and combustion apparatuses that provide metal knits on burners, methods for combustion of combustion apparatuses, methods for controlling combustion for combustion apparatuses, recording media, and water heaters.

ii) Description of the Related Art

Conventionally, a burner, in which a metal knit covers the surface of a porous plate and the air-fuel mixture is made to flow from the back of the porous plate to be combusted on the surface of the metal knit, is known as a knitted metal fiber burner (for example, Japanese Patent Application Laid-Open Publication No. 2001-235117, Japanese Patent Application Laid-Open Publication No. 2010-60149, and Japanese Patent Application Laid-Open Publication No. 2011-58746). A metal knit is a plate-shaped object that is knitted out of highly heat resistant metal fibers. An air-fuel mixture that is supplied from the back of a porous plate is combusted on a metal knit. Blue flame combustion and red heat combustion are examples of states of such combustion of fuel gas.

Concerning red heat combustion, it is known that the red heat state is switched to the stronger state or the weaker state by control of the amount of air that is supplied to a fixed amount of fuel gas (for example, Japanese Patent Application Laid-Open Publication No. 2005-143571).

BRIEF SUMMARY OF THE INVENTION

Burner combustion includes high intensity combustion and low intensity combustion. In low intensity combustion with a burner using a metal knit, the flow-out rate of an air-fuel mixture is held down, and the difference between the flow rate and the combustion rate is small. Thus, an air-fuel mixture, which flows out of a metal knit, combusts near the surface of the metal knit. This combustion heats the metal knit, and brings a red heat state (red heat mode). In this state of combustion, all flames, which are formed on the surface of the metal knit, are stabilized.

On the contrary, in high intensity combustion, the flow-out rate of part of an air-fuel mixture is higher than the combustion rate, and a main combustion zone is formed at a position far from the surface of a burner. Thus, red heat does not appear on a metal knit, flames are blue (blue flame mode), and a flame holding function of a metal knit is feeble. The problem in a case where the flame holding function is feeble is that flames lift-off and it is conspicuous to decrease the thermal efficiency, to emit excess carbon monoxide (CO) and so on.

The problem as to combustion is that an air-fuel mixture must be stably supplied for stabilizing flames and for holding down the emission of CO.

An object of the present invention is at least any one of the following.

Combustion is realized according to the requested amount of combustion of an air-fuel mixture.

High intensity combustion and low intensity combustion are carried out together, to stabilize flames and to hold down the emission of CO.

A mixing function of fuel gas with air is improved, to stabilize combusting flames and to hold down the emission of CO.

According to an aspect of the embodiments, a burner includes an air-fuel mixture outlet member that includes a single or a plurality of outlet(s) out of which an air-fuel mixture flows; and a metal fiber knitting body that covers the air-fuel mixture outlet member. Thereby, the air-fuel mixture, which is made to flow out of the outlet(s), passes through the metal fiber knitting body and is combusted, a flame of low intensity is generated together with a flame of high intensity by combustion of the air-fuel mixture, and the flame of low intensity holds the flame of high intensity.

According to another aspect of the embodiments, a combustion apparatus includes a burner; a single or a plurality of mixing chamber(s) that mix(es) fuel gas and air to generate an air-fuel mixture; and a single or a plurality of fixing unit(s) that disperse(s) the air-fuel mixture, which is obtained in the mixing chamber(s), to make the air-fuel mixture flow to the burner.

According to another aspect of the embodiments, a combustion apparatus includes a plurality of burner parts that carry out blue flame combustion; an air-fuel mixture supply unit that is disposed for the burner parts, and supplies an air-fuel mixture to the burner parts; and a control unit that selects, from the burner parts, a single or a plurality of burner part(s) that combust(s) the air-fuel mixture by switching the air-fuel mixture supply unit according to a requested amount of combustion of the air-fuel mixture, and that controls the combustion of the air-fuel mixture.

According to another aspect of the embodiments, a method for combustion includes making an air-fuel mixture flow out of a single or a plurality of outlet(s) that an air-fuel mixture outlet member includes; and passing the air-fuel mixture through a metal fiber knitting body that is disposed while covering the air-fuel mixture outlet member, combusting the air-fuel mixture, generating a flame of high intensity and a flame of low intensity by combustion of the air-fuel mixture, and holding the flame of high intensity by the flame of high intensity.

According to another aspect of the embodiments, a method for combustion includes disposing a single or a plurality of mixing chamber(s) that mix(es) fuel gas and air are to generate an air-fuel mixture for a burner, and dispersing the air-fuel mixture, which is obtained in the mixing chamber(s), by a single of a plurality of fixing unit(s) to make the air-fuel mixture flow to the burner; making the air-fuel mixture flow out of the burner; and generating a flame of high intensity and a flame of low intensity on the burner and holding the flame of high intensity by the flame of low intensity.

According to another aspect of the embodiments, a method or a process is for controlling combustion of an air-fuel mixture. This method or process includes selecting a single or a plurality of burner part(s) that combust(s) an air-fuel mixture, from a plurality of burner parts that carry out blue flame combustion by switching an air-fuel mixture supply unit that supplies the air-fuel mixture to the burner parts according to a requested amount of combustion of the air-fuel mixture, and controlling the combustion of the air-fuel mixture.

According to another aspect of the embodiments, a water heater includes a burner that includes an air-fuel mixture outlet member including a single or a plurality of outlet(s) out of which an air-fuel mixture flows, and a metal fiber knitting body covering the air-fuel mixture outlet member. Thereby, the air-fuel mixture, which is made to flow out of the outlet(s), passes through the metal fiber knitting body and is combusted, a flame of low intensity is generated together with a flame of high intensity by combustion of the air-fuel mixture, and the flame of low intensity holds the flame of high intensity.

According to another aspect of the embodiments, a water heater uses a combustion apparatus combusting fuel gas as a heat source. This water heater includes a burner; a single or a plurality of mixing chamber(s) that mix(es) fuel gas and air to generate an air-fuel mixture; and a single of a plurality of fixing unit(s) that disperse(s) the air-fuel mixture, which is obtained in the mixing chamber(s), to make the air-fuel mixture flow to the burner.

According to another aspect of the embodiments, a water heater uses a combustion apparatus combusting fuel gas as a heat source. This water heater includes a plurality of burner parts that carry out blue flame combustion; an air-fuel mixture supply unit that is disposed for a plurality of the burner parts, and supplies an air-fuel mixture to a plurality of the burner parts; and a control unit that selects, from the burner parts, a single or a plurality of burner part(s) that combust(s) the air-fuel mixture by switching the air-fuel mixture supply unit according to a requested amount of combustion of the air-fuel mixture, and controls the combustion of the air-fuel mixture.

Additional objects and advantages of the present invention will be apparent from the following detailed description of the invention, which are best understood with reference to the accompanying drawings.

DETAILED DESCRIPTION OF THE INVENTION

Figure 1:
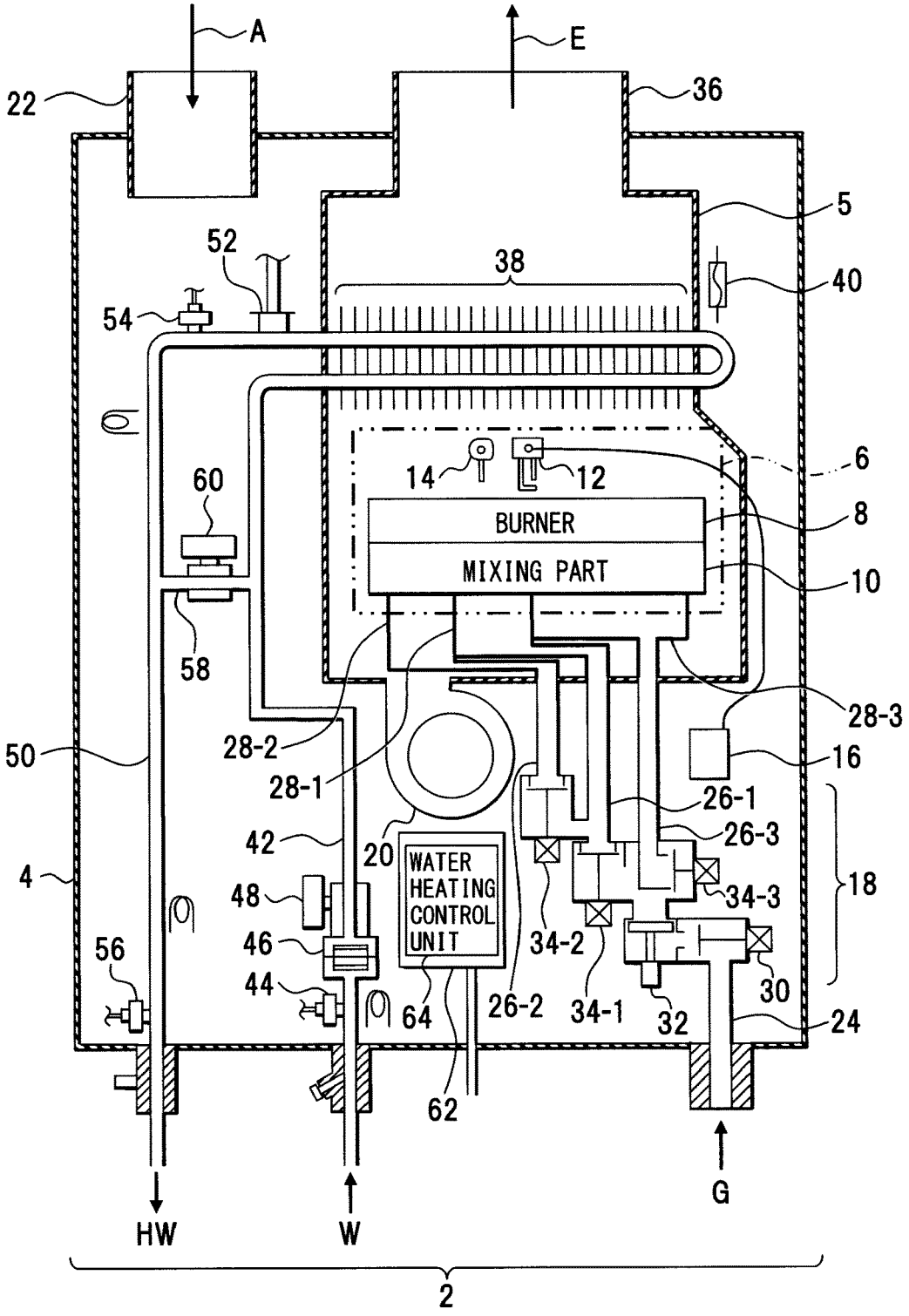
FIG. 1 depicts a water heater according to one embodiment.

FIG. 1 depicts one example of a water heater. A structure depicted in each drawing, as well as that in FIG. 1, is an example, and the present invention is not limited to such a structure.

Figure 15:
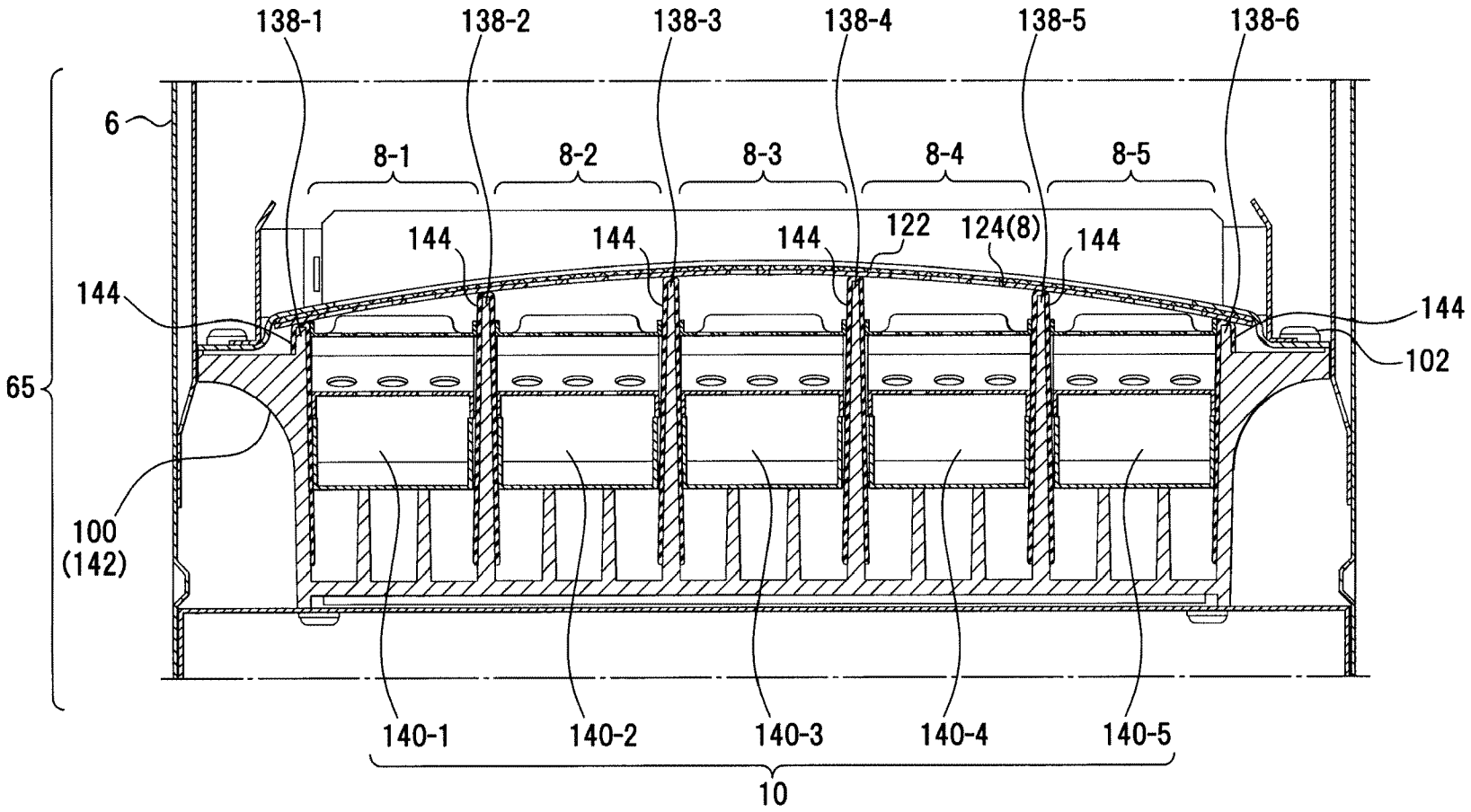
FIG. 15 is a cross-sectional view depicting the burner and a mixing part in the combustion chamber.

A housing 4 is provided for this water heater 2. A heat exchanger housing 5 is disposed in this housing 4. A combustion chamber 6 is included in this heat exchanger housing 5. A burner 8 that combusts an air-fuel mixture GA is disposed in this combustion chamber 6. The burner 8 is an example of a combustion apparatus for the air-fuel mixture GA. This burner 8 is divided into a plurality of burner parts 8-1, 8-2, 8-3, 8-4 and 8-5 (FIG. 15).

A spark plug 12 as an example of an ignition means that is, in other words, a firing device or a sparkler, and a flame rod 14 as an example of a flame detection means that is, in other words, a flame detection device or a flame detector, are disposed over the burner 8. An igniter 16 is connected to the spark plug 12. This igniter 16 allows the spark plug 12 generating sparks, to ignite the air-fuel mixture GA in the burner 8. The flame rod 14 detects the occurrence of combustion, through detecting flames.

A mixing part 10 is an example of a mixing unit that is, in other words, an air-furl mixture supply unit, an air-fuel mixture supply means, an air-fuel mixture supply device or an air-fuel mixture supplier. The mixing part 10 is included in a combustion apparatus, for example. The air-fuel mixture GA is generated in the mixing part 10 and is supplied to the burner 8 by the mixing part 10. Into the mixing part 10 of this embodiment, fuel gas G is supplied through a valve unit 18 and air A is supplied by an air supply fan 20. The air supply fan 20 is disposed below the combustion chamber 6, and takes in air, which is in the housing 4. An air inlet 22 is disposed for the housing 4. The air A is taken in the housing 4 through the air inlet 22.

The valve unit 18 makes the fuel gas G that is supplied to a gas supply pipe 24 flow into one of gas supply pipes 26-1, 26-2 and 26-3, or the valve unit 18 divides the fuel gas G and makes the fuel gas G flow into two or more of the gas supply pipes 26-1, 26-2 and 26-3, to supply the fuel gas G to one or more fuel gas jet part(s) 28-1, 28-2 and 28-3. The valve unit 18 provides therefor a main valve 30, a proportional valve 32 and gas solenoid valves 34-1, 34-2 and 34-3 in order of the fuel gas G flowing. The main valve 30 switches states of the fuel gas G between supply and blocking. The proportional valve 32 adjusts the supply of the fuel gas G. The gas solenoid valves 34-1, 34-2 and 34-3 correspond to the fuel gas jet parts 28-1, 28-2 and 28-3 respectively. When the gas solenoid valve 34-1 is opened, the fuel gas G is supplied to the fuel gas jet part 28-1. When the gas solenoid valve 34-2 is opened, the fuel gas G is supplied to the fuel gas jet part 28-2. When the gas solenoid valve 34-3 is opened, the fuel gas G is supplied to the fuel gas jet part 28-3.

Combustion exhaust E that is generated in the combustion chamber 6 flows out of the combustion chamber 6 to a cylindrical flue 36. A heat exchanger 38 that is disposed above the combustion chamber 6 exchanges latent heat and sensible heat that the combustion exhaust E has with tap water W. The combustion exhaust E after the heat exchange is emitted via the cylindrical flue 36 to the outside. A thermal fuse 40 is disposed close to the combustion chamber 6.

The tap water W is supplied to the heat exchanger 38 via a water supply pipe 42. A temperature sensor 44, a water flow sensor 46 and a water flow control valve 48 are disposed along this water supply pipe 42. The temperature sensor 44 detects a temperature of supplied water. The water flow sensor 46 detects the supply of water and the occurrence of water supply. The water flow control valve 48 controls water supply. The water flow sensor 46 of this embodiment is disposed at the water flow control valve 48.

Hot water HW that is obtained from the heat exchanger 38 is supplied via a hot water supply pipe 50. A water heating high limit switch 52 and temperature sensors 54 and 56 are disposed along this hot water supply pipe 50. The water heating high limit switch 52 stops the supply of the fuel gas G when a temperature of hot water that is flowing out of the heat exchanger 38 is over the upper limit. The temperature sensor 54 detects a temperature in the outlet side of the heat exchanger 38.

A bypassing pipe 58 is disposed between the water supply pipe 42 and the hot water supply pipe 50. A bypassed water control valve 60 is disposed at this bypassing pipe 58. The tap water W is supplied from the water supply pipe 42 via the bypassing pipe 58 to the hot water supply pipe 50 according to open and close of this bypassed water control valve 60, and this tap water W is mixed with the hot water HW. The temperature sensor 56 detects a temperature of the hot water HW, which has been mixed with the tap water W.

A computer board 62 is disposed close to the air supply fan 20. A water heating control unit 64 is disposed in this computer board 62. The water heating control unit 64 is an example of a controlling means that controls combustion of an air-fuel mixture according to the requested amount of combustion of the air-fuel mixture GA. This water heating control unit 64 includes a controlling means such as a processor.

<Internal Structure of Heat Exchanger Housing 5, and Valve Unit 18>

Figure 2:
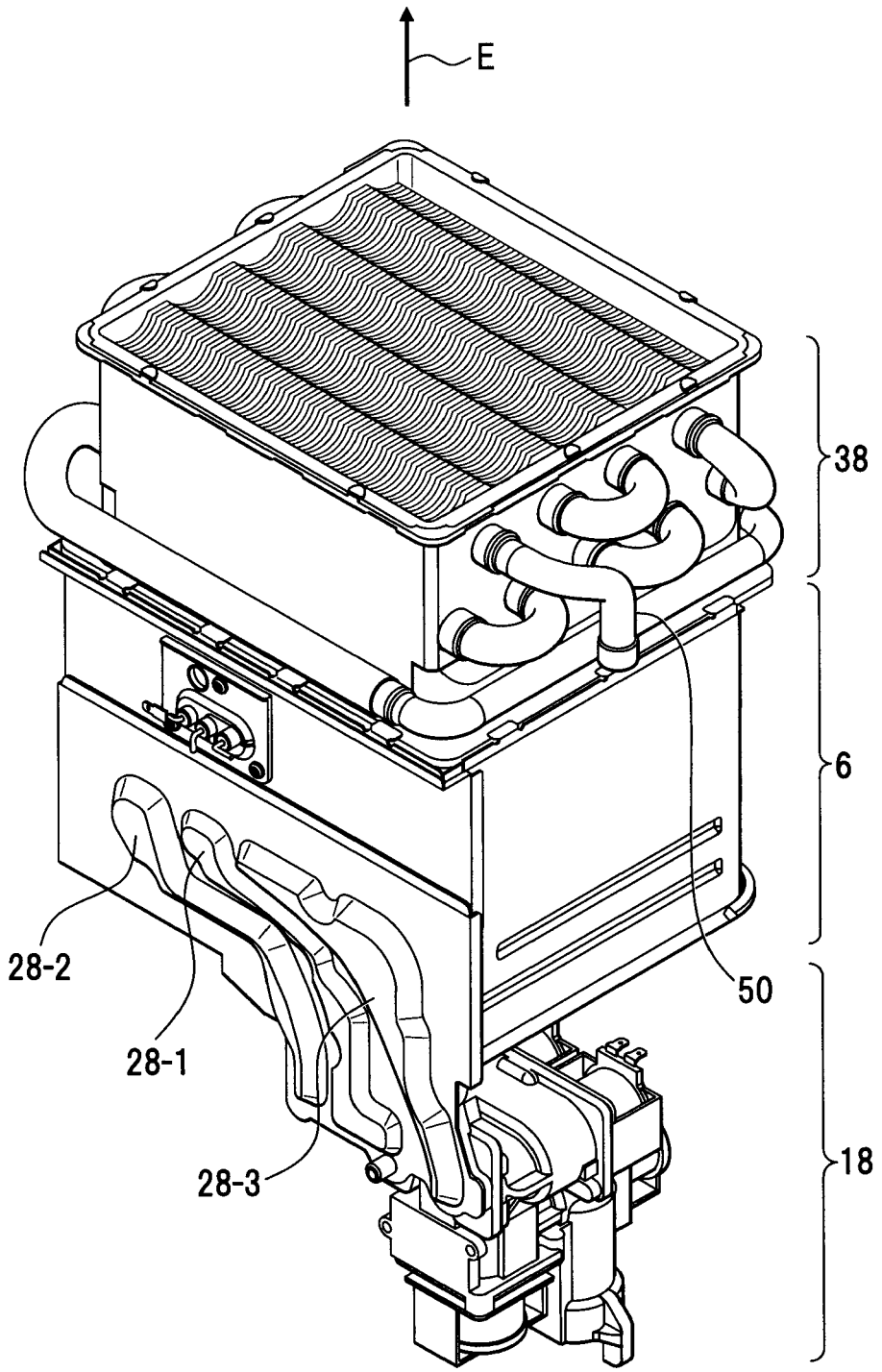
FIG. 2 is a perspective view depicting a heat exchanger housing.

FIG. 2 depicts an internal structure of the heat exchanger housing 5, and the valve unit 18. The combustion chamber 6 and the heat exchanger 38 are provided for the heat exchanger housing 5. The heat exchanger 38 is fixed on the top of the combustion chamber 6. The above described cylindrical flue 36 is disposed over the heat exchanger 38. The combustion exhaust E that is generated in the combustion chamber 6 flows to the cylindrical flue 36 via the heat exchanger 38.

The valve unit 18 is disposed below the combustion chamber 6, and the fuel gas jet parts 28-1, 28-2 and 28-3 are disposed on the front side of the combustion chamber 6. The valve unit 18 is coupled to the fuel gas jet parts 28-1, 28-2 and 28-3.

<Combustion Chamber 6>

Figure 3:
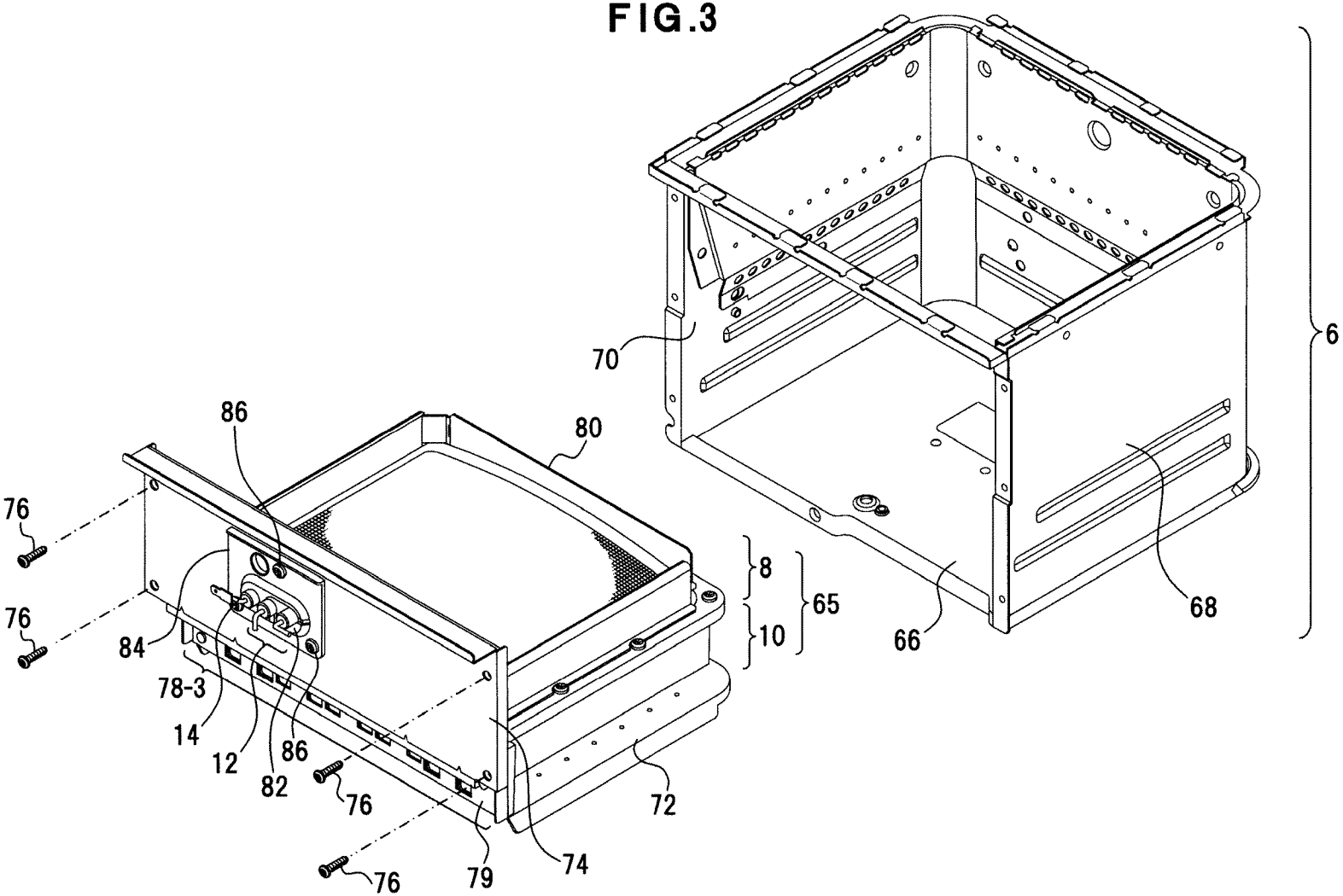
FIG. 3 is an exploded perspective view depicting a structure of a combustion chamber.
Figure 4:
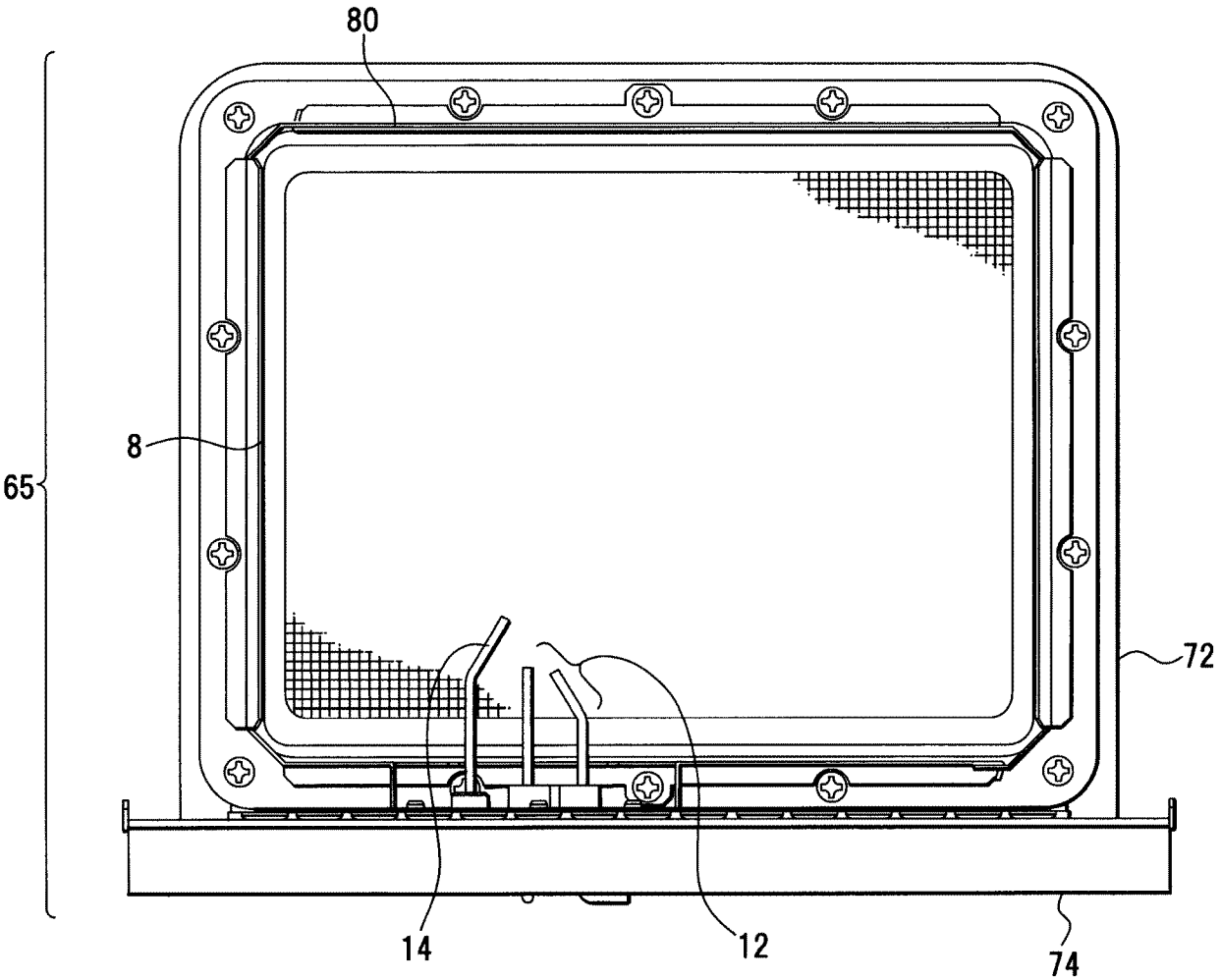
FIG. 4 is a top plan view of a burner.

FIG. 3 depicts the combustion chamber 6 and a burner and mixing part unit 65. FIG. 4 depicts the burner and mixing part unit 65 viewed from the top.

The combustion chamber 6 is a housing that includes a bottom 66 and side walls 68. An opening 70 is formed in the front of the combustion chamber 6. The burner and mixing part unit 65 is a member that is a unity of the burner 8 and the mixing part 10, and includes a seating 72 and a side wall panel 74. The mixing part 10 is fixed to the seating 72. The burner 8 is attached to the mixing part 10.

The side wall panel 74 is unitedly formed together with the seating 72, and is disposed on the front of the combustion chamber 6. If the seating 72 is put into the combustion chamber 6, the side wall panel 74 is positioned in the opening 70 of the combustion chamber 6, and the opening 70 is blocked by the side wall panel 74.

The side wall panel 74 is fastened to the side walls 68 of the combustion chamber 6 by fixing screws 76 in the openable and closeable manner. An air-fuel intake part 78-2 (FIG. 6) through which the mixing part 10 takes in the fuel gas G and the air A is formed on the side wall panel 74 while an air-fuel intake part 78-1 (FIG. 6) is formed on the mixing part 10. An air baffle plate 79 is disposed on this side wall panel 74. An air-fuel intake part 78-3 (FIG. 6) is formed in this air baffle plate 79.

The mixing part 10 is disposed on the seating 72. The burner 8 is disposed on the top of this mixing part 10. A flame guiding frame 80 is disposed along sides of the burner 8. Flames are guided just over the burner 8 by this flame guiding frame 80.

An isolating rest 82 is disposed on the side wall panel 74. The spark plug 12 and the flame rod 14 are attached to this isolating rest 82. The isolating rest 82 is fastened to the side wall panel 74 by fixing screws 86 through a supporting plate 84.

These spark plug 12 and flame rod 14 protrude from the back of the side wall panel 74 and are disposed over the burner 8 as depicted in FIG. 4.

<Valve Unit 18, Burner and Mixing Part Unit 65 and Fuel Gas Jet Parts 28-1, 28-3 and 28-3>

Figure 5:
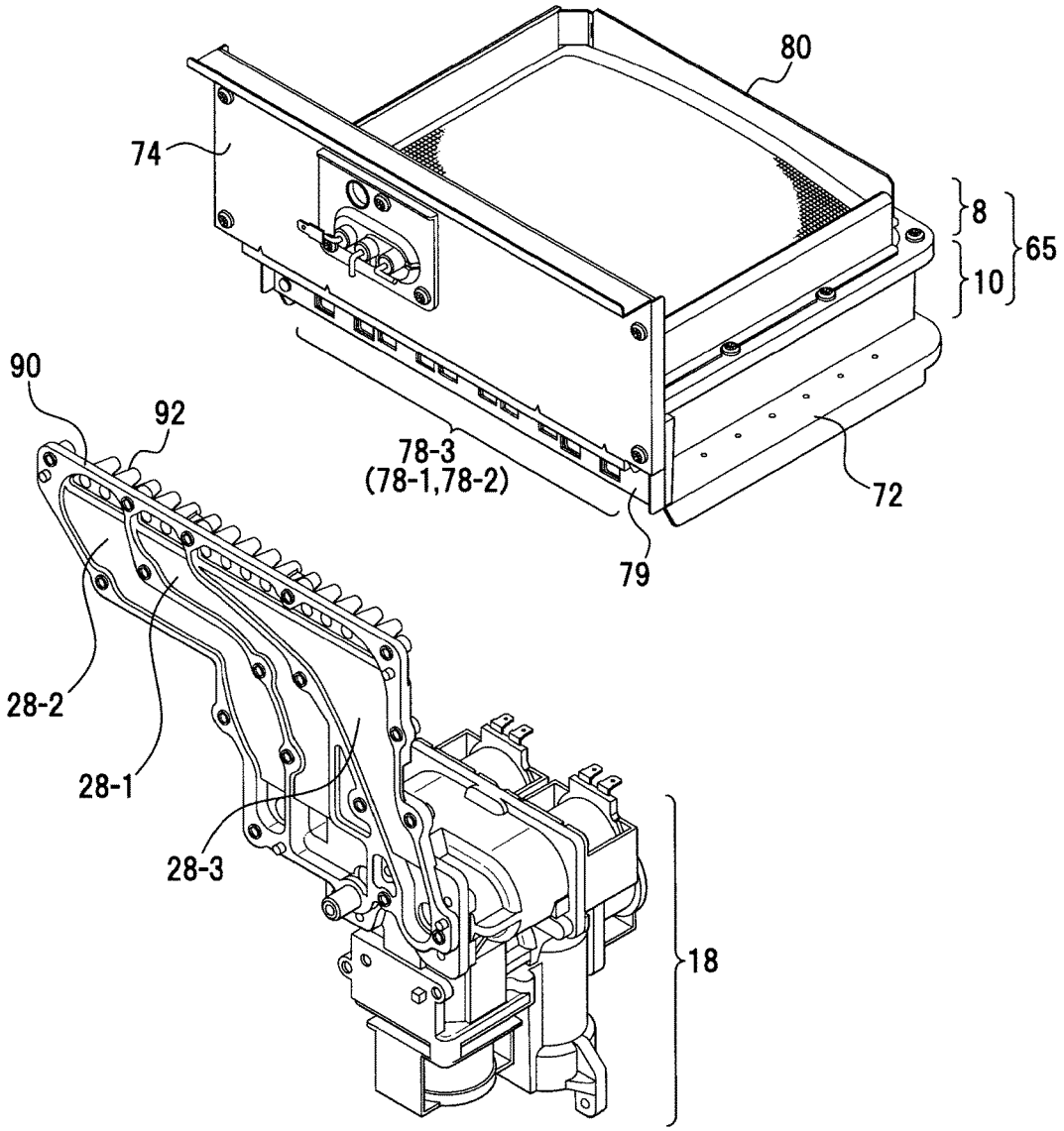
FIG. 5 is an exploded perspective view depicting a burner and mixing part unit, fuel gas jet parts and a valve unit.
Figure 6:
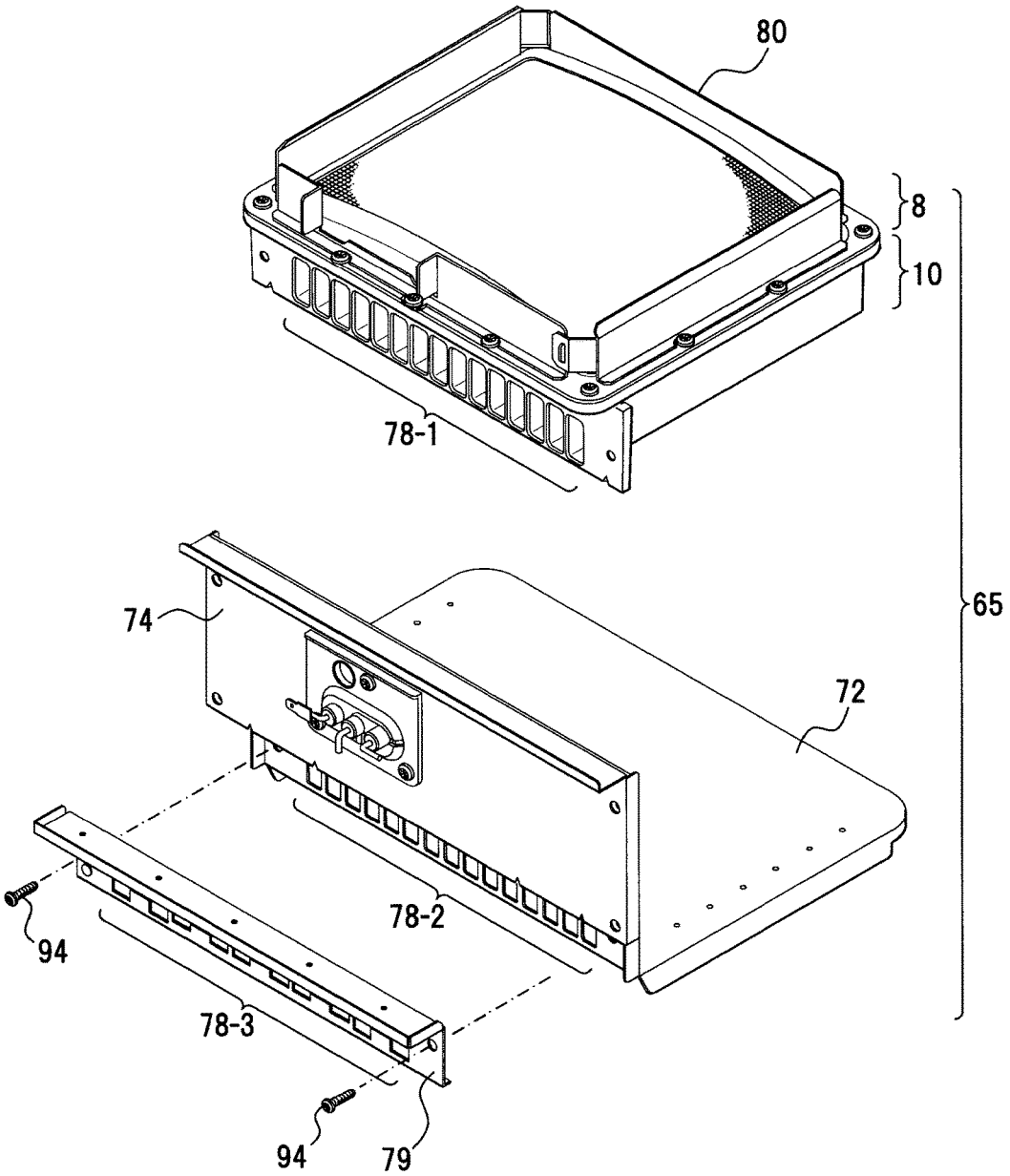
FIG. 6 is an exploded perspective view depicting the burner and mixing part unit.

FIG. 5 depicts the valve unit 18, the burner and mixing part unit 65 and the fuel gas jet parts 28-1, 28-3 and 28-3. FIG. 6 depicts the burner and mixing part unit 65, which is exploded.

The above described side wall panel 74 is disposed on the front of the mixing part 10. The fuel gas jet parts 28-1, 28-3 and 28-3 are disposed on the front of the air baffle plate 79 that is disposed on the front of the side wall panel 74. The supply of the air A to the mixing part 10 is adjusted by the air baffle plate 79.

A fuel gas jet nozzle unit 90 is provided for the fuel gas jet parts 28-1, 28-3 and 28-3. A plurality of nozzles 92 are disposed on this fuel gas jet nozzle unit 90. In this embodiment, fifteen of the nozzles 92 are disposed. The fuel gas G that is shot from each nozzle 92 is supplied to the mixing part 10 through the air-fuel intake part 78-3 of the air baffle plate 79.

The burner and mixing part unit 65 can be divided into the mixing part 10 and the seating 72 as depicted in FIG. 6. The above described air-fuel intake part 78-2 is formed on the side wall panel 74. The air baffle plate 79 is fastened to the side wall panel 74 by fixing screws 94.

Figure 7A:
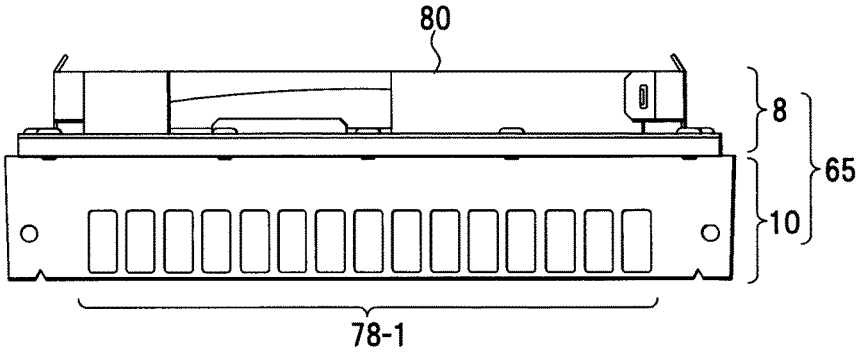
FIGS. 7A to 7C depict fuel gas and air intakes.
Figure 7B:
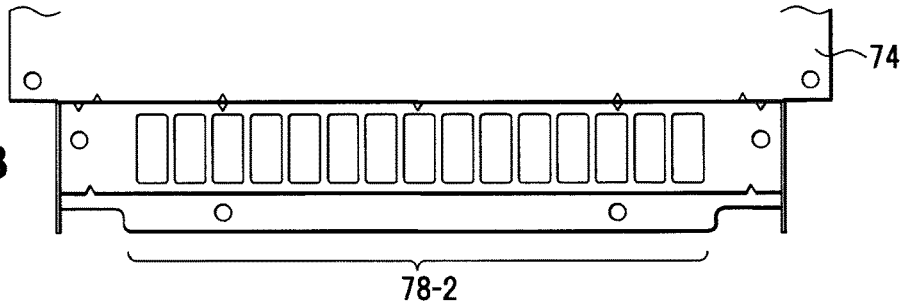
Figure 7C:
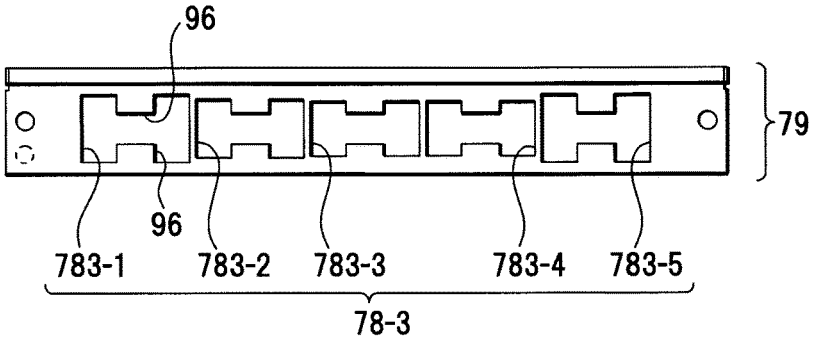

FIG. 7A depicts the air-fuel intake part 78-1 of the mixing part 10, FIG. 7B depicts the air-fuel intake part 78-2 of the side wall panel 74 and FIG. 7C depicts the air-fuel intake part 78-3 of the air baffle plate 79.

The mixing part 10 is formed by die cast molding, for example. This die cast molding forms on the mixing part 10 the air-fuel intake part 78-1 that include a plurality of openings of the same shape (for example, a rectangle). In this embodiment, fifteen intakes in the air-fuel intake part 78-1 are arranged so as to be directed perpendicularly to flames (horizontally).

The side wall panel 74 is disposed as covering the air-fuel intake part 78-1 of the mixing part 10. Thus, the air-fuel intake part 78-2 of the side wall panel 74 has the same shape as the air-fuel intake part 78-1.

Air-fuel intakes 783-1, 783-2, 783-3, 783-4 and 783-5 are formed in the air baffle plate 79 as the air-fuel intake part 78-3 having a plurality (in this embodiment, five) of intakes of different shapes, while the intakes in the air-fuel intake parts 78-1 and 78-2 are the same shape. Three intakes in the air-fuel intake part 78-1 or 78-2, which are adjacent to each other, form each intake in the air-fuel intake part 78-3. Each intake in the air-fuel intake part 78-3 is a rectangular shape that corresponds to three intakes in the air-fuel intake part 78-1 or 78-2.

The opening area of each air-fuel intake 783-1 and 783-5 which are nearest to both sides is the biggest. The opening area of the air-fuel intake 783-3 which is in the middle is the smallest. That is, the nearer to the center an intake is, the smaller its opening area is. This is in order to correct the unevenness of the flow of the air A that is supplied by the air supply fan 20, and to take in air of the same amount through each air-fuel intake 78-1, 78-2 and 78-3.

A protrusion 96 that protrudes from the center of each upper and lower edge of each inlet of the air-fuel intake part 78-3 is formed. Protruding length of the protrusions 96 of each air-fuel intake 783-1 to 783-5 is different from each other. That is, the protrusions 96 narrow the middle opening area of each air-fuel intake 783-1, 783-2, 783-3, 783-4 and 783-5 according to the protruding length thereof.

Therefore, the opening area of the air-fuel intake part 78-3 of the air baffle plate 79 and the opening shape according to the protrusions 96 partially adjust the intake of the air A, which is taken in from the air-fuel intake part 78-1 of the mixing part 10, each inlet of which is formed in the same shape. In contrast to such adjustment of the intake of the air A, the fuel gas G is adjusted by the valve unit 18.

<Burner and Mixing Part Unit 65>

Figure 8:
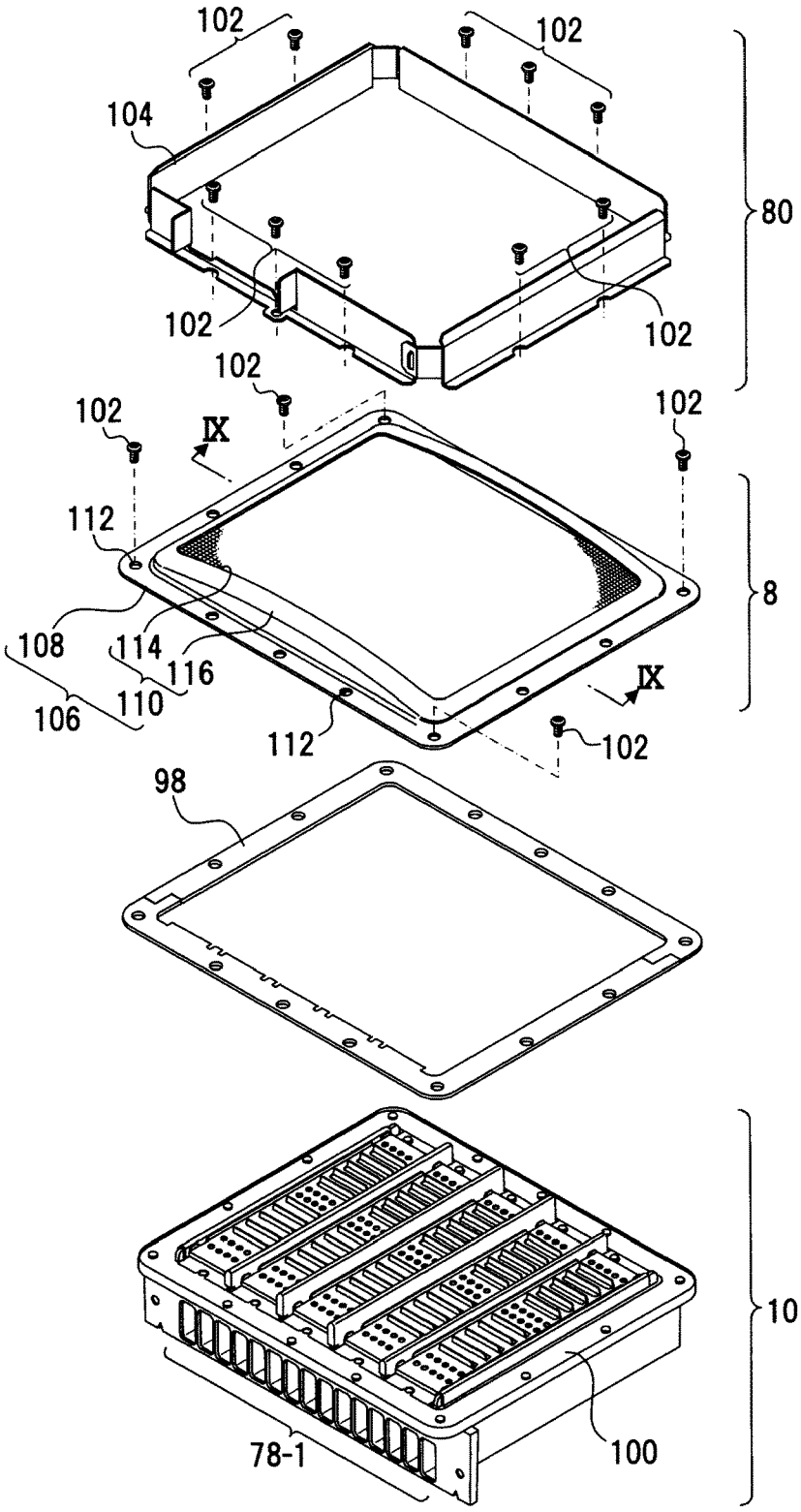
FIG. 8 is an exploded perspective view depicting the burner and mixing part unit.

FIG. 8 depicts the burner and mixing part unit 65 that is exploded. This burner and mixing part unit 65 includes the burner 8, the mixing part 10, the flame guiding frame 80 and packing 98. A flange 100 is formed along the edge of the mixing part 10. The burner 8 is fastened to this flange 100 by fixing screws 102 through the packing 98.

The flame guiding frame 80 is a casing formed by a plurality of panels 104 coupled rectangularly. This flame guiding frame 80 is fastened to the flange 100 of the mixing part 10 by the fixing screws 102 from the top of the burner 8.

Figure 9:
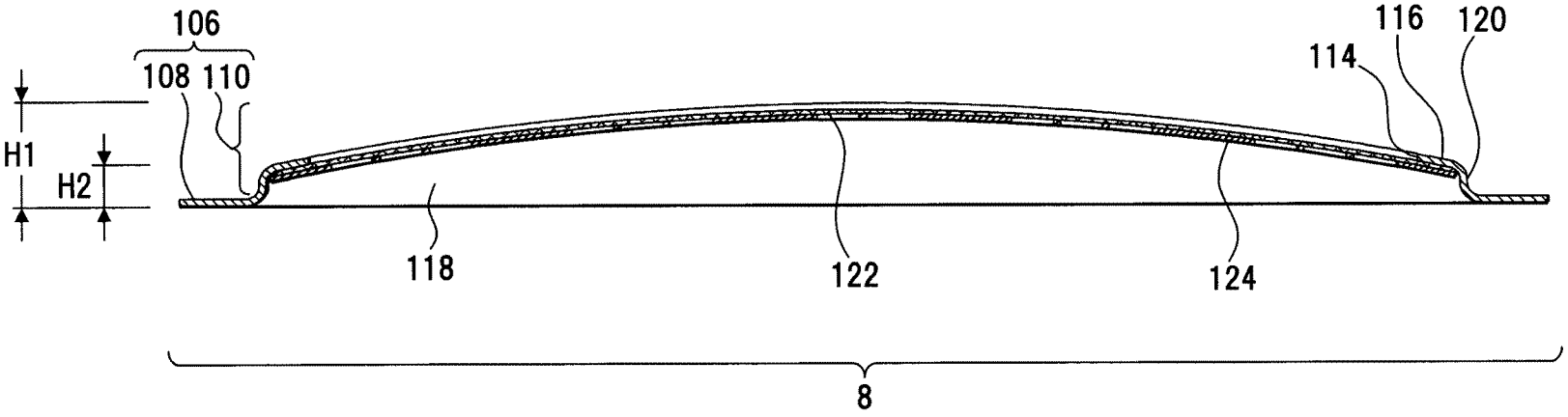
FIG. 9 is a cross-sectional view taken along the line IX-IX in FIG. 8.
Figure 10:
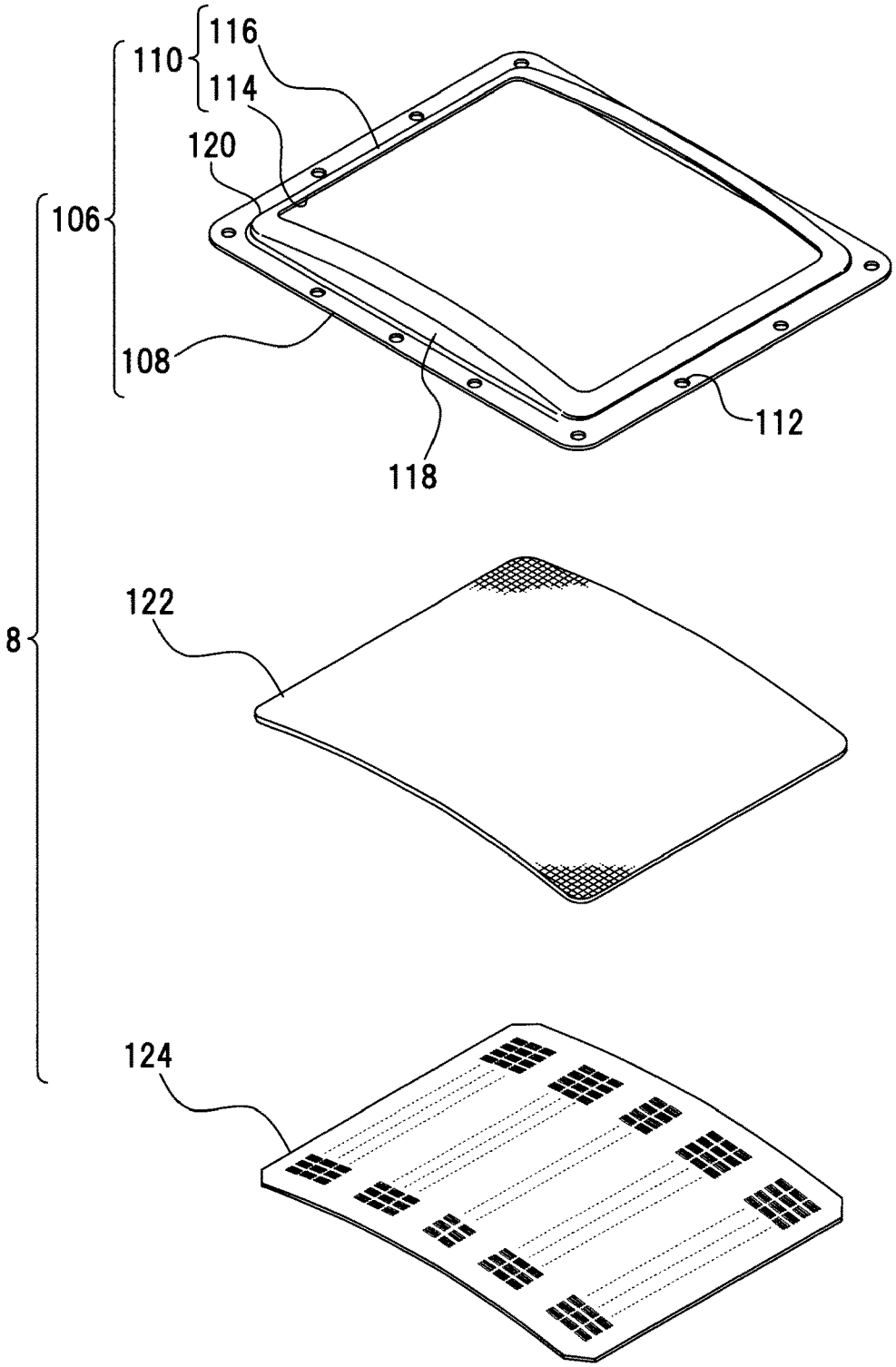
FIG. 10 is an exploded perspective view depicting the burner.

FIG. 9 depicts a cross-section taken along the line IX-IX in FIG. 8. FIG. 10 depicts the burner 8 that is exploded. A burner frame 106 of a rectangular flat shape is provided for this burner 8. This burner frame 106 is formed by molding of heat-resistant metal, for example a sheet of stainless steel. A flange 108 and a bulged part 110 are unitedly formed for this burner frame 106. The flange 108 is a rectangular loop, and constitutes a flat face of a constant width around the edge of the bulged part 110. A plurality of fixing holes 112 are formed in the flange 108.

A rectangular window 114 and an edge part 116 that runs around the window 114 are provided for the bulged part 110. Each of standing walls 118 that is a pair and faces each other is provided between the edge part 116 and the flange 108. A pair of standing walls 120 that are perpendicular to these standing walls 118 is provided.

The standing wall 118 is disposed along a longer side of the burner frame 106, has the top in the middle thereof, and is arcuate. The standing wall 120 is disposed along a shorter side of the burner frame 106, has the same height as the flange 108, and is parallel to the flange 108. If the height of the standing wall 118 at the top is H1 and the height of the standing wall 118 at the bottom, and of the standing wall 120 is H2, the relationship of measurement between H1 and H2 is, for example, H1>H2.

According to such relationship of measurement, the flange 108 is a plane face in the burner frame 106, and the burner frame 106 the top of which has the height H1 and protrudes is a graduate mountain-like shape (arcuate shape) since the standing wall 118 is arcuate. That is, the burner frame 106 arcuately protrudes. The burner frame 106 may be a dome-like shape (hemispherical shape).

A metal knit 122 that allows the air-fuel mixture GA to passed therethrough is disposed for this burner frame 106. This metal knit 122 is a flat metal fiber net body that is knitted out of fibers, which are formed by heat-resistant metal and are gathered like threads, by stitch knitting etc.

The metal knit 122 is arranged in a curving state, along the window 114 of the bulged part 110 in the burner frame 106. A back plate 124 is disposed on the back of this metal knit 122.

This back plate 124 is an example of an air-fuel mixture outlet member for the air-fuel mixture GA. The back plate 124 adjusts the flow rate of the air-fuel mixture GA that is made to flow toward the metal knit 122.

The air-fuel mixture GA, which is passed through the metal knit 122, combusts over the metal knit 122. A red heat state is brought to the metal knit 122 when the air-fuel mixture GA combusts over the metal knit 122 like the above. Deformation of the metal knit 122, which is expanded due to this red heat, is dissolved by the metal knit 122, which is kept in the curving state. Thus, the metal knit 122 is kept in the curving state along the window 114 of the bulged part 110.

The edge part 116 of the burner frame 106, the metal knit 122 and the back plate 124, which are burner elements, are unitedly fixed together by spot welding to be united, so that the burner 8 is constituted.

<Metal Knit 122>

Figure 11:
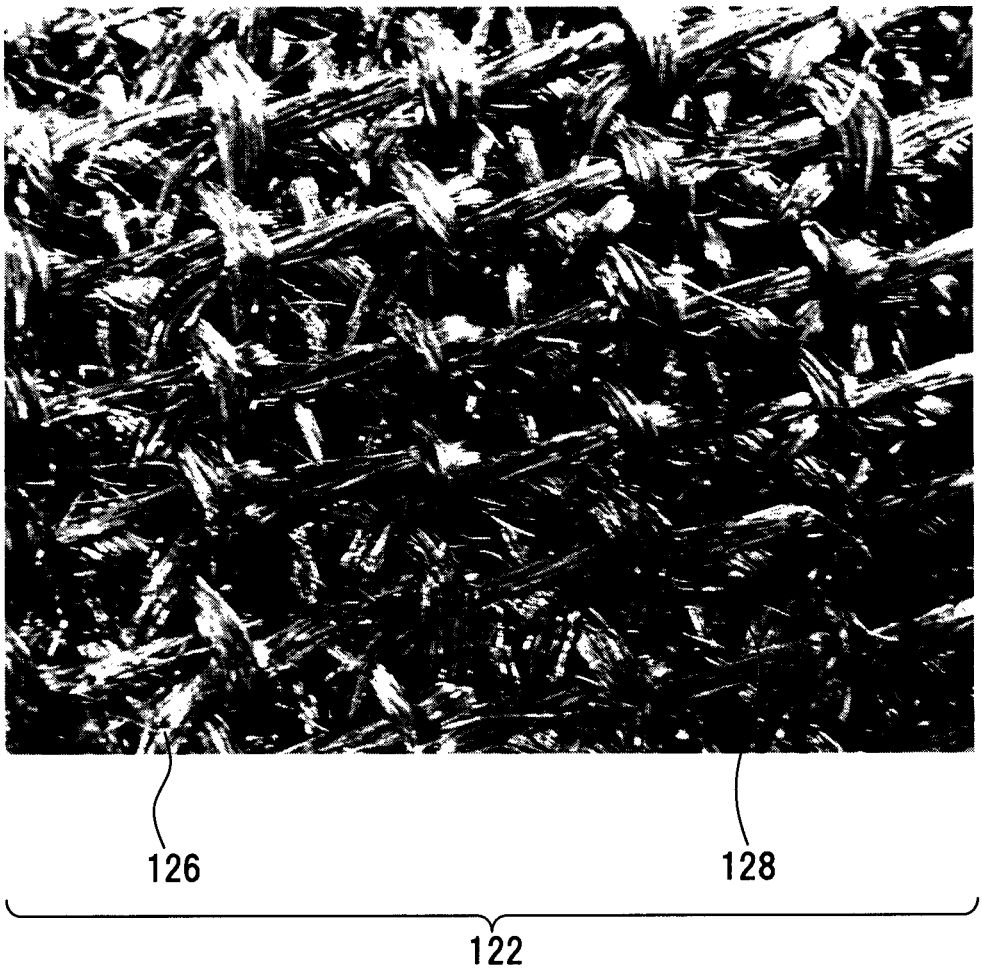
FIG. 11 is a partially enlarged view of a metal knit.

FIG. 11 depicts partial enlargement of the metal knit 122 that is an example. This metal knit 122 is an example of a metal fiber knitting body. For example, this metal knit 122 is knitted out of four metal fiber bodies 126 by stitch knitting to be like a flat plate. A metal fiber body 126 is, for example, a gather of plural fibers of stainless steel like a thread. This metal knit 122 provides innumerable and irregular air holes 128.

The metal knit 122 has air permeability, and also has flexibility, elasticity and shape retention since the metal knit 122 is a net body as described above. The air-fuel mixture GA can pass through this metal knit 122 because the metal knit 122 has air permeability. The metal knit 122 is also deformable in the direction same as the plane and in the direction crossing the plane (vertically) because having elasticity. The shape of the metal knit 122 is retained along the back plate 124 (shape retention) because the metal knit 122 is an elastic net body.

<Back Plate 124>

Figure 12:
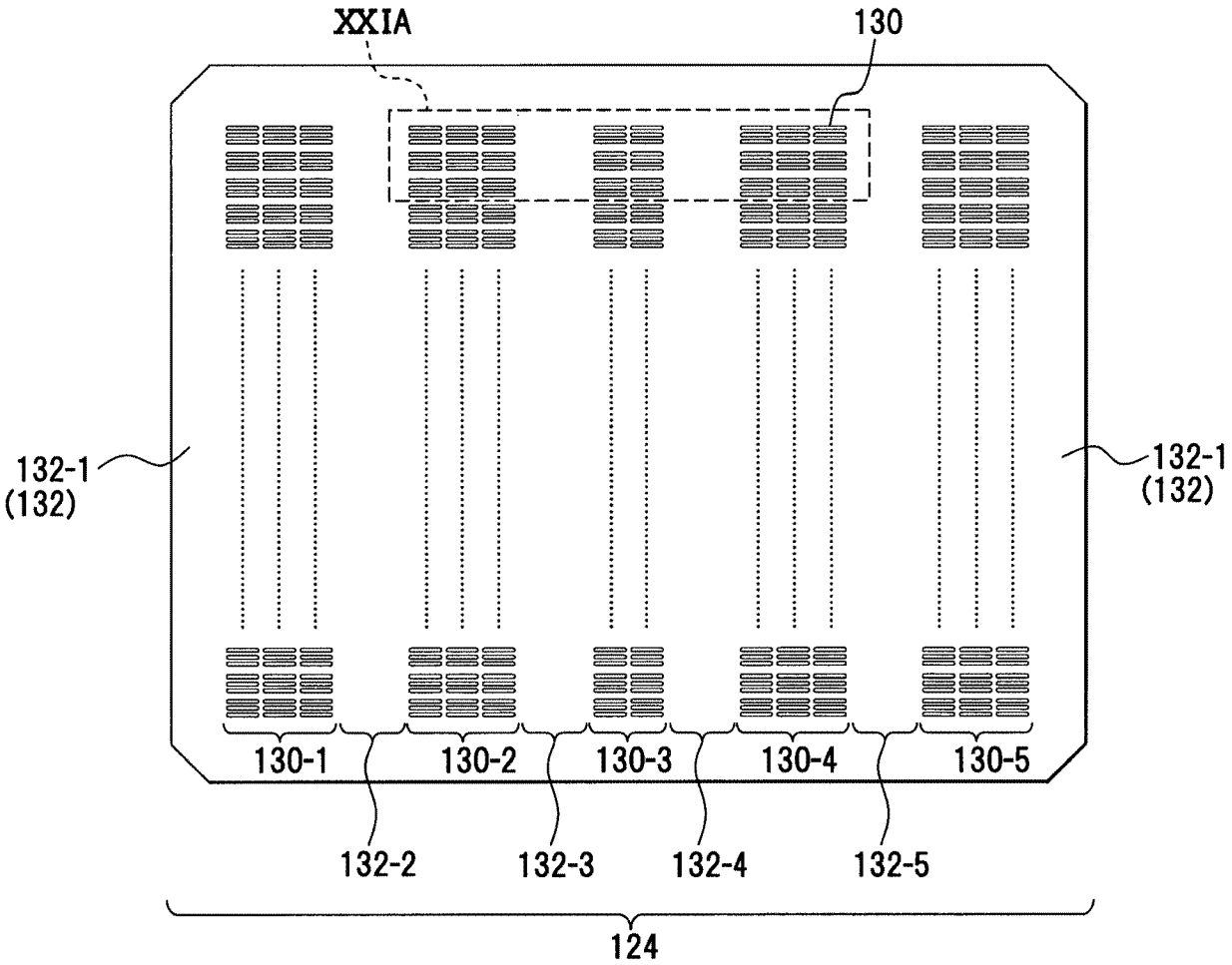
FIG. 12 is a plan view depicting one example of a back plate.
Figure 13A:
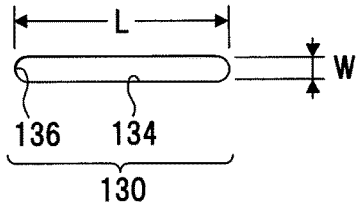
FIGS. 13A to 13D depict an air-fuel mixture outlet, a group of air-fuel mixture outlets (one unit of a plurality of air-fuel mixture outlets), and a squad of air-fuel mixture outlets (one unit of a plurality of groups of air-fuel mixture outlets) on the back plate.

FIG. 12 depicts an example of the back plate 124. This back plate 124 is a punching metal sheet that includes a plurality of air-fuel mixture outlets (hereinafter just referred to as "outlets") 130 that are openings, and a closed part 132 that is an unopened part. The outlet 130 is an opening that allows the air-fuel mixture GA to pass therethrough. The closed part 132 is a barrier that blocks the air-fuel mixture GA. The outlet 130 is an example of a slit-like burner port, and allows the air-fuel mixture GA to pass therethrough. The closed part 132 is a blocking part that surrounds the outlets 130. That is, the flow intensity is inverse proportion to the area of the outlets. For example, a stainless steel sheet as a heat-resistant plate is used for the back plate 124. The thickness of this stainless steel sheet d is thinner than the width W of the outlet 130 (FIG. 13A).

The outlets 130 are arranged like a matrix of a plurality of rows and columns. A first outlet area 130-1, a second outlet area 130-2, a third outlet area 130-3, a fourth outlet area 130-4 and a fifth outlet area 130-5, each of which is an aggregate of the outlets 130, are formed on the back plate 124. The closed part 132 is constituted by a first closed area 132-1, a second closed area 132-2, a third closed area 132-3, a fourth closed area 132-4 and a fifth closed area 132-5. While the flow rate of the air-fuel mixture GA through the flow-out hole 130 is high and the flow-out hole 130 is a part of high intensity, the closed part 132, or the closed area 132-1, 312-2, 132-3, 132-4 and 132-5, constitute(s) (a) part(s) of low intensity because the air-fuel mixture GA, the flow rate of which is decreased, is supplied to the closed part 132, or the closed areas 132-1, 312-2, 132-3, 132-4 and 132-5.

The closed area 132-1 is set on the rim of the back plate 124 like a circle. The outlet area 130-3 is arranged in the middle of the back plate 124. The outlet areas 130-2 and 130-4 are arranged while holding this outlet area 130-3 therebetween. The closed area 132-3 is arranged between the outlet areas 130-2 and 130-3, and the closed area 132-4 is arranged between the outlet areas 130-3 and 130-4. The outlet area 130-1 is arranged outside the outlet area 130-2, while the outlet areas 130-1 and 130-2 hold the closed area 132-2 therebetween. The outlet area 130-5 is arranged outside the outlet area 130-4, while the outlet areas 130-4 and 130-5 hold the closed area 132-5 therebetween.

In short, the outlet area 130-1 is surrounded by the closed areas 132-1 and 132-2. The outlet area 130-2 is surrounded by the closed areas 132-2 and 132-3. The outlet area 130-3 is surrounded by the closed areas 132-3 and 132-4. The outlet area 130-4 is surrounded by the closed areas 132-4 and 132-5. The outlet area 130-5 is surrounded by the closed areas 132-1 and 132-5.

<Outlet Pattern>

The outlet 130 is constituted by a thin elliptic slit as depicted in FIG. 13A. The outlet 130 includes a parallel part 134 that has the length L and the width W, and curving parts 136.

Figure 13B:
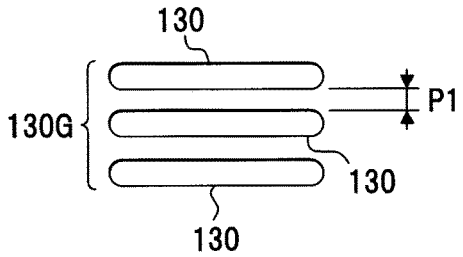

Every three outlets 130, which are arranged in parallel in the direction of a shorter side thereof, constitute a group of outlets 130G as depicted in FIG. 13B. The outlets 130 are arranged in parallel in the direction of a shorter side of the outlets 130 in the group of outlets 130G.

Figure 13C:
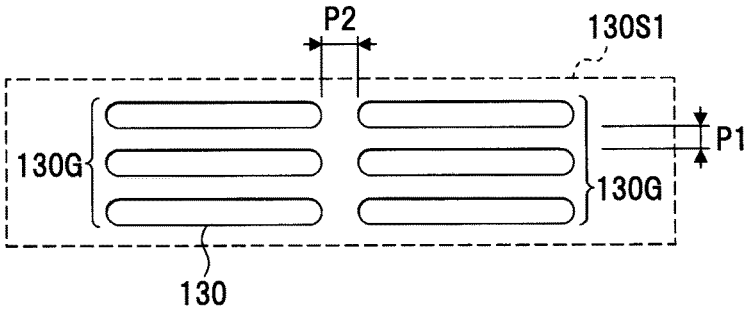
Figure 13D:
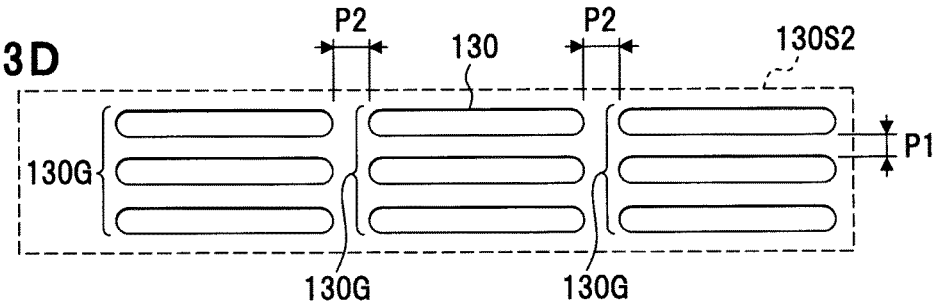

The groups of outlets 130G are arranged in a plurality of rows and columns to constitute a squad of outlets 130S1 as depicted in FIG. 13C, or to constitute a squad of outlets 130S2 as depicted in FIG. 13D. In this case, if the direction of a longer side of the burner 8 is an X axis direction and the direction of a shorter side of the burner 8 is a Y axis, row numbers can be given in the X axis direction and column numbers can be given in the Y axis direction. The squad of outlets 130S1 is constituted by three rows and two columns of the outlets 130. The squad of outlets 130S2 is constituted by three rows and three columns of the outlets 130.

A clearance P2 that is in the direction of a longer side of the group of outlets 130G is set wider than a clearance P1 in the squads of outlets 130S1 and 1302S. A clearance P3 that is in the direction of a shorter side of the group of outlets 130G is set wider than the clearance P2.

Figure 14:
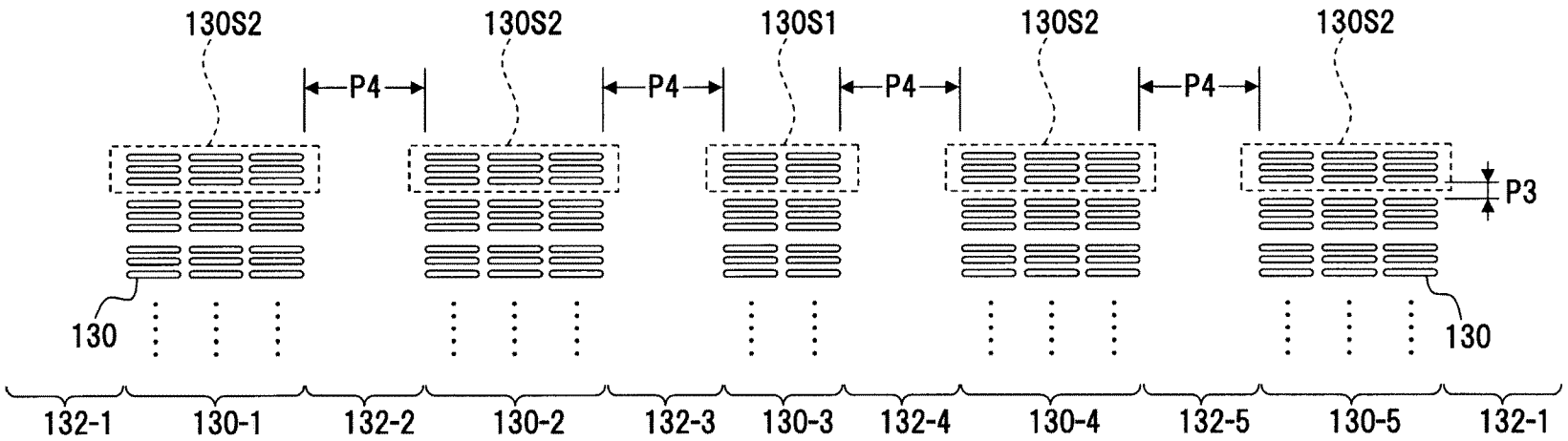
FIG. 14 depicts a pattern of air-fuel mixture outlets.

The squads of outlets 130S1 and 1302S are arranged as depicted in FIG. 14. A clearance P4 that is in the direction of a longer side of the squads of outlets 130S1 and 1302S is set wider than the clearance P3.

While the outlets 130 constitute openings in the back plate 124, the clearances P1, P2, P3 and P4 constitute the closed part 132 on the back plate 124.

(a) Outlet 130 that is Unit of Opening (FIG. 13A)

The outlet 130 is surrounded by the closed part 132 that is thin and consists of the clearance P1 and P2. The outlet 130 that is surrounded by such a closed part 132 constitutes a part of high intensity, or an outlet part of high intensity.

(b) Group of Outlets 130G that is Unit of Aggregate of Openings (FIG. 13B)

The group of outlets 130G that is an aggregate of the outlets 130 is surrounded by the closed part 132 that consists of the clearances P2 and P3. The group of outlets 130G that is surrounded by such a closed part 132 constitutes a part of high intensity, or an outlet part of high intensity.

(c) Squads of Outlets 130S1 and 130S2 each of which is Unit of Aggregate of Opening (FIGS. 13C and 13D)

The squads of outlets 130S1 and 130S2 as an aggregate of a plurality of the groups of outlets 130G are surrounded by the closed part 132 that consists of the clearances P3 and P4. Each squad of outlets 130S1 and 130S2 that is surrounded by such a closed part 132 constitutes a part of high intensity, or an outlet part of high intensity.

(d) Outlet Areas 130-2, 130-3 and 130-4 Each of which is Unit of Aggregate of Openings (FIG. 14)

The outlet area 130-3 that is an aggregate of a plurality of the squads of outlets 130S1 is surrounded by the closed part 132 that consists of the clearances P3 and P4. The outlet area 130-3 that is surrounded by such a closed part 132 constitutes a part of high intensity, or an outlet part of high intensity.

The outlet areas 130-2 and 130-4 each of which is an aggregate of a plurality of the squads of outlets 130S2 is surrounded by the closed part 132 that consists of the clearances P3 and P4. Each outlet area 130-2 and 130-4 that is surrounded by such a closed part 132 constitutes a part of high intensity, or an outlet part of high intensity.

<Cross-Sectional Structure of Burner and Mixing Part Unit 65>

FIG. 15 depicts the cross-sectional structure of the burner and mixing part unit 65.

A plurality of division walls 138-1, 138-2, 138-3, 138-4, 138-5 and 138-6 are disposed in the mixing part 10. Thereby, the mixing part 10 is divided into a plurality of mixing chambers 140-1, 140-2, 140-3, 140-4 and 140-5. That is, each mixing chamber 140-1, 140-2, 140-3, 140-4 and 140-5 constitutes an independent space.

The division walls 138-1, 138-2, 138-3, 138-4, 138-5 and 138-6 are formed by die cast molding of a mixing part housing 142 of the mixing part 10. The heights of the division walls 138-1, 138-2, 138-3, 138-4, 138-5 and 138-6 are set according to the curving face of the bulged part 110 of the burner frame 106. The surfaces of the division walls 138-1, 138-2, 138-3, 138-4, 138-5 and 138-6 are covered by sealing members 144. The sealing member 144 is formed by a resin material that has heat-resistance and elasticity. These sealing members 144 allow the upper edges of the division walls 138-1, 138-2, 138-3, 138-4, 138-5 and 138-6 to adhere to the closed part 132 on the back plate 124 of the burner 8. In short, the air-fuel mixture GA is prevented from leaking through and interfering in the division walls 138-1, 138-2, 138-3, 138-4, 138-5 and 138-6.

Thus, the back plate 124 of the burner 8 is divided by the division walls 138-1, 138-2, 138-3, 138-4, 138-5 and 138-6. That is, the burner 8 is separated into a plurality of the burner parts 8-1, 8-2, 8-3, 8-4 and 8-5, and the burner parts 8-1, 8-2, 8-3, 8-4 and 8-5, which are independent of each other, are constituted for the mixing chambers 140-1, 140-2, 140-3, 140-4 and 140-5, respectively. In short, a plurality of the burner parts 8-1, 8-2, 8-3, 8-4 and 8-5 are arranged like a plane face along the curving face of the back plate 124, which curves.

As to the relationship between the outlets 130 in the back plate 124 and the burner parts 8-1, 8-2, 8-3, 8-4 and 8-5, the burner part 8-1 corresponds to the outlet area 130-1, the burner part 8-2 corresponds to the outlet area 130-2, the burner part 8-3 corresponds to the outlet area 130-3, the burner part 8-4 corresponds to the outlet area 130-4, and the burner part 8-5 corresponds to the outlet area 130-5. That is, the mixing chamber 140-1 corresponds to the outlet area 130-1, the mixing chamber 140-2 corresponds to the outlet area 130-2, the mixing chamber 140-3 corresponds to the outlet area 130-3, the mixing chamber 140-4 corresponds to the outlet area 130-4, and the mixing chamber 140-5 corresponds to the outlet area 130-5.

Figure 16:
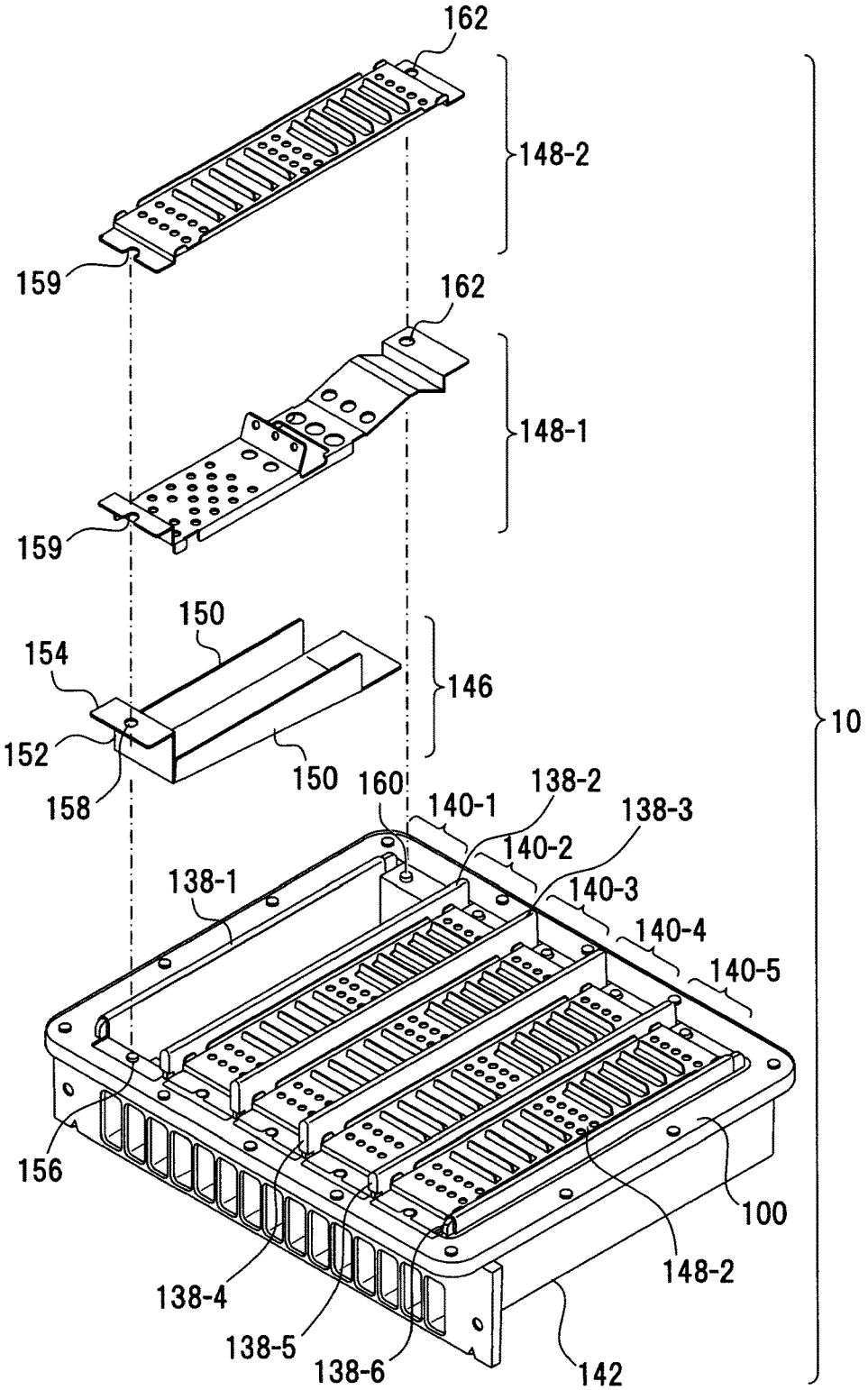
FIG. 16 is an exploded perspective view depicting the mixing part that is partially exploded.
Figure 17:
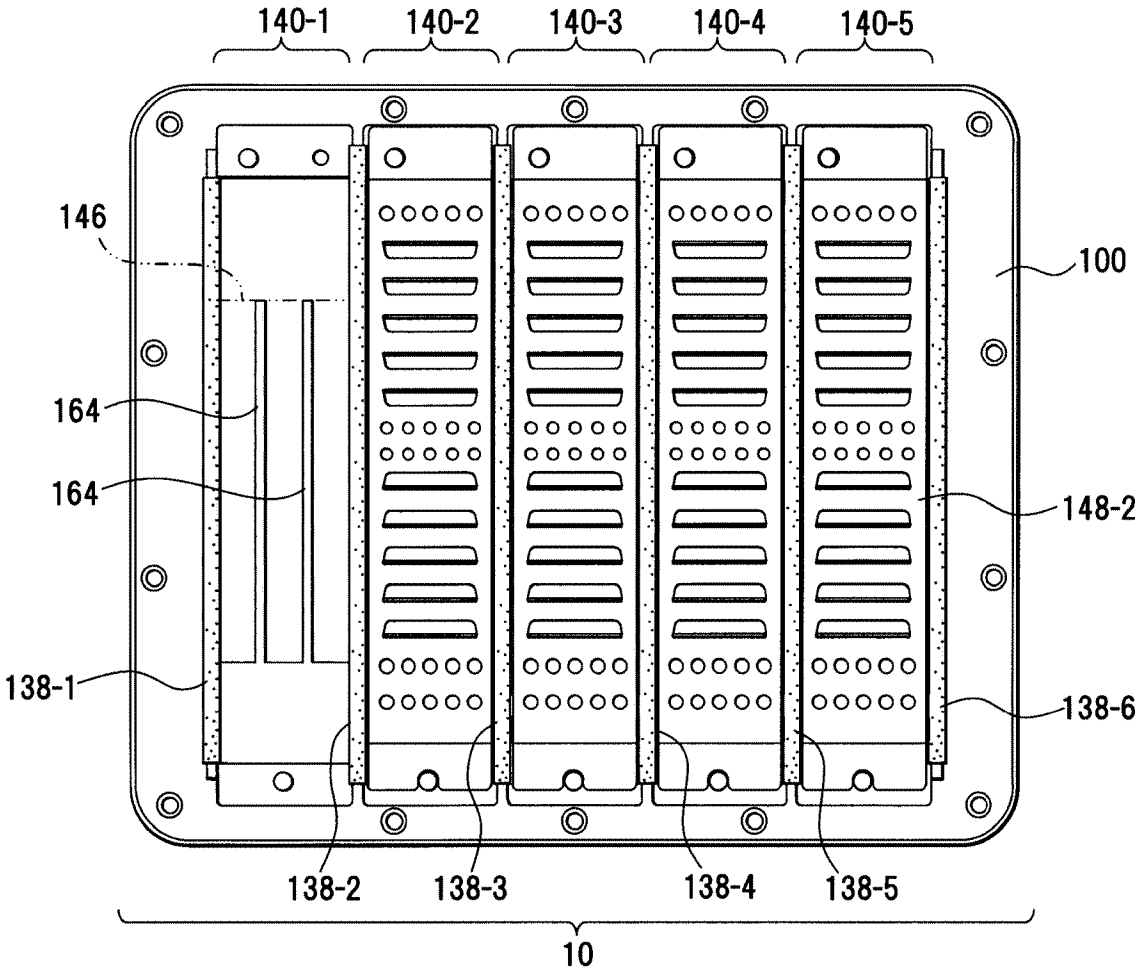
FIG. 17 is a plan view depicting the mixing part from which a fixing plate is removed so as to expose a part of mixing chambers.

FIG. 16 depicts the mixing part 10 that is partially exploded. FIG. 17 depicts the mixing part 10 from which parts of a separation plate and a fixing plate are removed.

A separation plate 146, and a first fixing plate 148-1 and second fixing plate 148-2 as a fixing part for the air-fuel mixture GA are disposed on each mixing chambers 140-1, 140-2, 140-3, 140-4 and 140-5 in the mixing part 10. A pair of side walls 150 is formed, each of which is along a side of the separation plate 146. The side wall 150 is fit between each of the division walls 138-1, 138-2, 138-3, 138-4, 138-5 and 138-6, to be held. A side wall 152 that is higher than the side wall 150 is formed along the base part of the separation plate 146. A supporting part 154 is formed along the top of this side wall 152. This supporting part 154 is put on the flange 100 of the mixing part housing 142. A protrusion 156 of the flange 100 is fit into a through hole 158, to position and support the supporting part 154.

The fixing plates 148-1 and 148-2 are superposed and disposed over the top surface side of the separation plate 146, which is disposed in each mixing chamber 140-1, 140-2, 140-3, 140-4 and 140-5. A concave part 159 and a through hole 162 are formed in each fixing plate 148-1 and 148-2. The concave part 159 and the through hole 162 are fit into the protrusions 156 and 160 of the mixing part housing 142 respectively, to position and support the fixing plate 148-1. The fixing plate 148-2 is disposed on the top surface of this fixing plate 148-1. The concave part 159 and the through hole 162 are fit into the protrusions 156 and 160 of the mixing part housing 142 respectively, to position and support the fixing plate 148-2 as well as the fixing plate 148-1. Each fixing plate 148-1 and 148-2 is an example of a fixing unit that fixes the air-fuel mixture GA.

A plurality of separation walls 164 are formed in each mixing chamber 140-1, 140-2, 140-3, 140-4 and 140-5 in the direction of the flow of the fuel gas G and the air A as depicted in FIG. 17. The separation walls 164 support the separation plate 146, and divide and separate the space that is below the separation plate 146 into a space for each intake in the air-fuel intake part 78-1 (FIG. 8). In this embodiment, the separation walls 164 in each mixing chamber correspond to three intakes in the air-fuel intake part 78-1, and divide the space below the separation plate 146 into three. Therefore, two separation walls are provided. The number of the disposed separation walls 164 may be less than three, and more than two.

<Mixing Chambers 140-1, 140-2, 140-3, 140-4 and 140-5>

Figure 18:
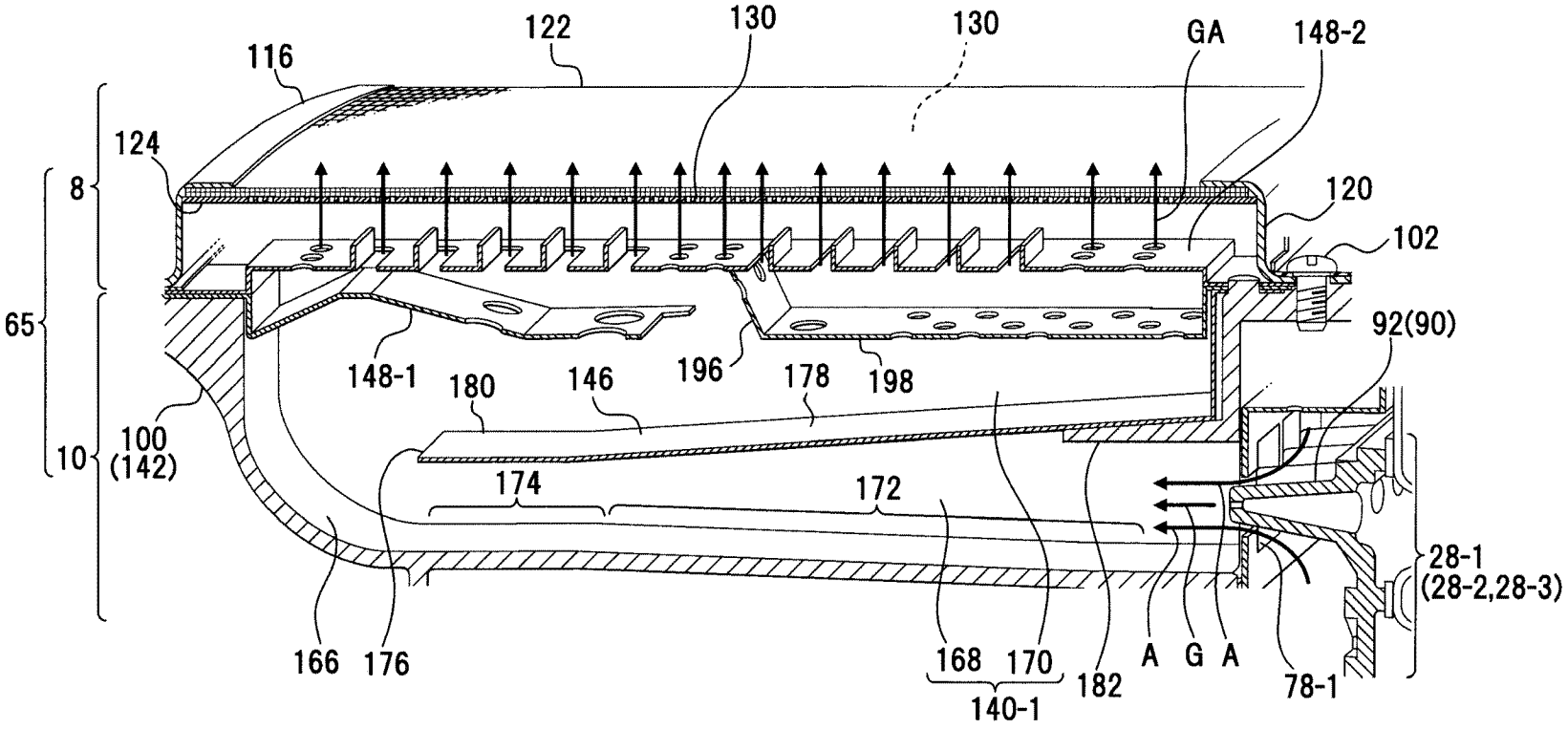
FIG. 18 is a cross-sectional view depicting the burner and the mixing part in the combustion chamber.
Figure 19A:
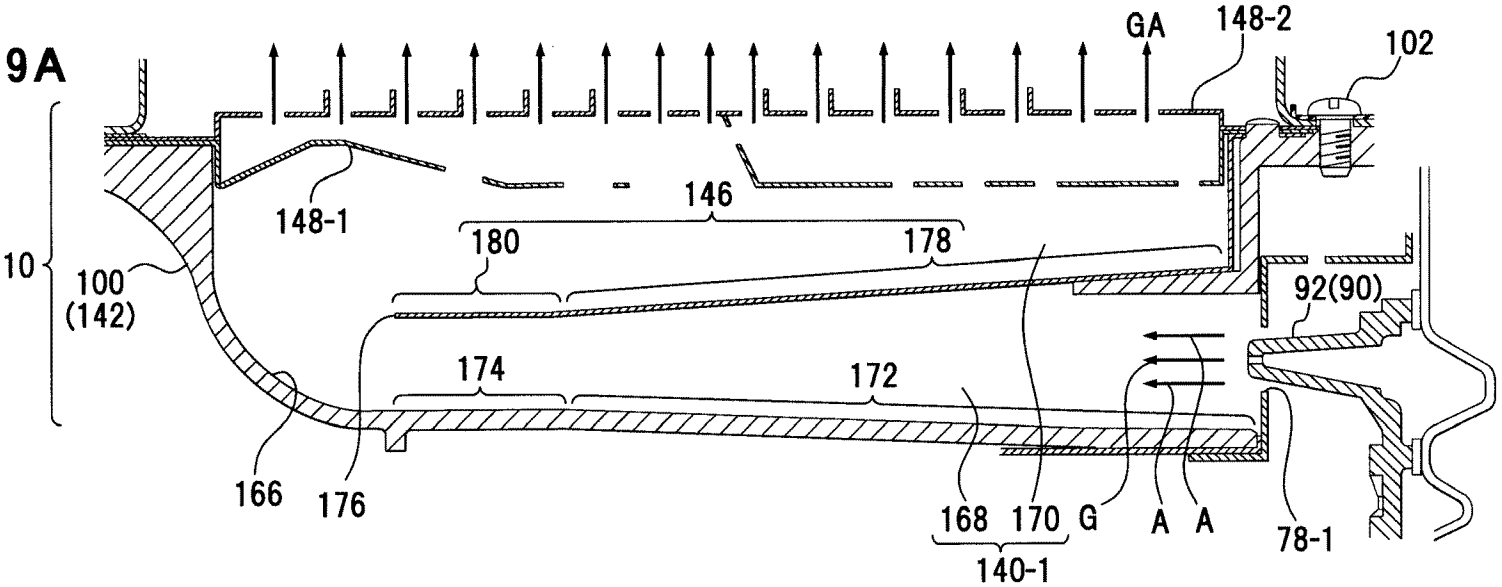
FIGS. 19A and 19B are cross-sectional end views depicting a vertical cross-sectional end of the mixing part and a vertical cross-sectional end of the fixing plate of the combustion apparatus.
Figure 19B:
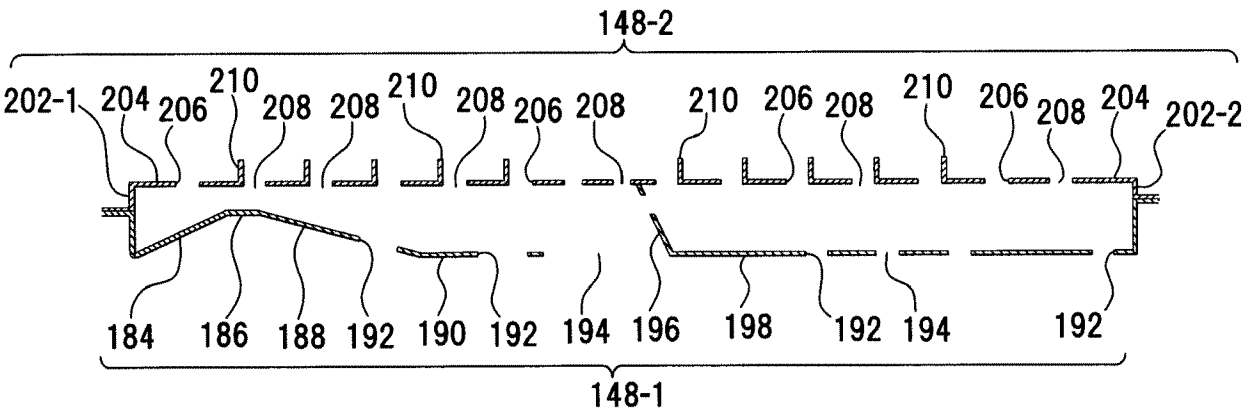

FIG. 18 depicts a cross-section of the mixing chamber 140-1. FIGS. 19A and 19B depict cross-sectional ends of the mixing chamber 140-1 and the fixing plates 148-1 and 148-2.

The mixing chamber 140-1 mixes the fuel gas G and the air A, to generate the air-fuel mixture GA and supply the air-fuel mixture GA to the burner 8. The mixing chamber 140-1 is a space for mixing the fuel gas G and the air A. The separation plate 146, the air-fuel intake part 78-1 and a flow changing part 166 are provided for the mixing chamber 140-1. The structure of the mixing chambers 140-2, 140-3, 140-4 and 140-5 is the same as this.

The mixing chamber 140-1 is divided into a lower chamber 168 and an upper chamber 170 by the separation plate 146. The bottom of the lower chamber 168 includes an inclined face 172 that inclines upward from the air-fuel intake part 78-1 toward the flow changing part 166, and a horizontal face 174 that starts from the end of this inclined face 172 and is horizontal. A through hole part 176 is formed in the lower chamber 168 and the lower chamber 168 is opened. The separation plate 146 includes an inclined face 178 that descends from the air-fuel intake part 78-1 side toward the flow changing part 166, and a horizontal face 180 that starts from the end of this inclined face 178 toward the flow changing part 166 and is horizontal. That is, the distance between the bottom of the mixing chamber 140-1 and the separation plate 146 is the longest in the air-fuel intake part 78-1 side, a narrow space is formed by the inclined faces 172 and 178, and the narrowest space consisting of the parallel planes of the horizontal faces 174 and 180 (first orifice) is formed. The separation plate 146 is attached to the mixing part housing 142, and is supported by a supporting part 182 that protrudes over the mixing chamber 140-1.

The flow changing part 166 is an example of a flow changer, and is a curving wall that starts from the lower chamber 168 to the upper chamber 170. The through hole part 176 is divided by the flow changing part 166 and the edge of the separation plate 146.

The fixing plates 148-1 and 148-2 are arranged over the top of the upper chamber 170, fix the air-fuel mixture GA, and to supply the air-fuel mixture GA to the burner 8. For example, the fixing plates 148-1 and 148-2 are molded sheet metal members made of thin stainless steel sheets, on which a sheet metal process is carried out.

The fixing plate 148-1 constitutes the ceiling of the upper chamber 170. The fixing plate 148-2 is horizontally or inclinedly arranged between the back plate 124 of the burner 8 and the fixing plate 148-1.

The fixing plate 148-1 is arranged, so that part of the flow changing part 166, and the inclined face 178 and the horizontal face 180 of the separation plate 146 is covered as depicted in FIGS. 19A and 19B. This fixing plate 148-1 includes an inclined face 184 that inclines towards the direction of enlarging the space around the flow changing part 166 as depicted in FIG. 19B. A horizontal face 186 is provided for the end of this inclined face 184. An inclined face 188 descending from this horizontal face 186 is formed. A horizontal face 190 is formed, starting from the end of this inclined face 188. A plurality of through holes 192 are formed in each inclined face 188 and horizontal face 190. A through hole part 194 is formed in the middle of this fixing plate 148-1 in the longitudinal direction. A barrier face 196 is provided for the end of this through hole part 194. This barrier face 196 forms a barrier face that is slightly inclined toward the through hole part 194. A horizontal face 198 is disposed at the bottom end of this barrier face 196. A plurality of the through holes 192 are formed in the horizontal face 198. The separation plate 146 is inclined against the horizontal face 198. The nearer to the end of the horizontal face 198 the space of the upper chamber 170 is, the more the space of the upper chamber 170 narrows (second orifice). After turned at the flow changing part 166, the air-fuel mixture GA, which flows out of the lower chamber 168, flows along the fixing plate 148-1, is directed to the upper chamber 170, passes through the through holes 192 and the through hole part 194 in the fixing plate 148-1, and flows toward the fixing plate 148-2.

The fixing plate 148-2 includes a pair of rising parts 202-1 and 202-2 as depicted in FIG. 19B. In this embodiment, the rising part 202-1 is set taller than the rising part 202-2. A horizontal face 204 is formed between these rising parts 202-1 and 202-2. A plurality of through holes 206 and windows 208 are formed in the horizontal face 204. The through holes 206 are circular holes, and are formed in the center and end parts. The window 208 is perforated, holding the center part where the through holes 206 are formed, and is a rectangular shape. A standing wall 210 that is made by lancing of the window 208 is formed along the edge of the window 208. Each standing wall 210 stands vertically, and regulates the direction of the flow of the air-fuel mixture GA to the burner 8. The flow of the air-fuel mixture GA, which flows from the fixing plate 148-1, is fixed by the fixing plate 148-2 to parallel flow, to flow to the burner 8.

If the fuel gas G is shot from the fuel gas jet nozzle unit 90 and the air A flows to the combustion chamber 140-1, the fuel gas G and the air A hit the flow changing part 166 after initially mixed in the lower chamber 168. The fuel gas G and the air A, which are flowing, change their states from the compressed state to the released state to be mixed because the space around the flow change part 166 is enlarged more than the lower chamber 168. Thereby, the air-fuel mixture GA is generated in the mixing chamber 140-1. Such a change of the flow rate and turn at the flow changing part 166 allow the mixture of the fuel gas G and the air A to progress.

The air-fuel mixture GA that has reached the top face of the separation plate 146 is guided from the top face side of the separation plate 146 toward the fixing plates 148-1 and 148-2. The flow of the air-fuel mixture GA that has passed through the fixing plate 148-1 is fixed by the fixing plate 148-2 to parallel flow, to reach the burner 8.

In the burner 8, the air-fuel mixture GA passes through the metal knit 122 from the outlets 130 in the back plate 124. The air-fuel mixture GA that has passed through the metal knit 122 combusts.

<Water Heating Control Unit 64>

Figure 20:
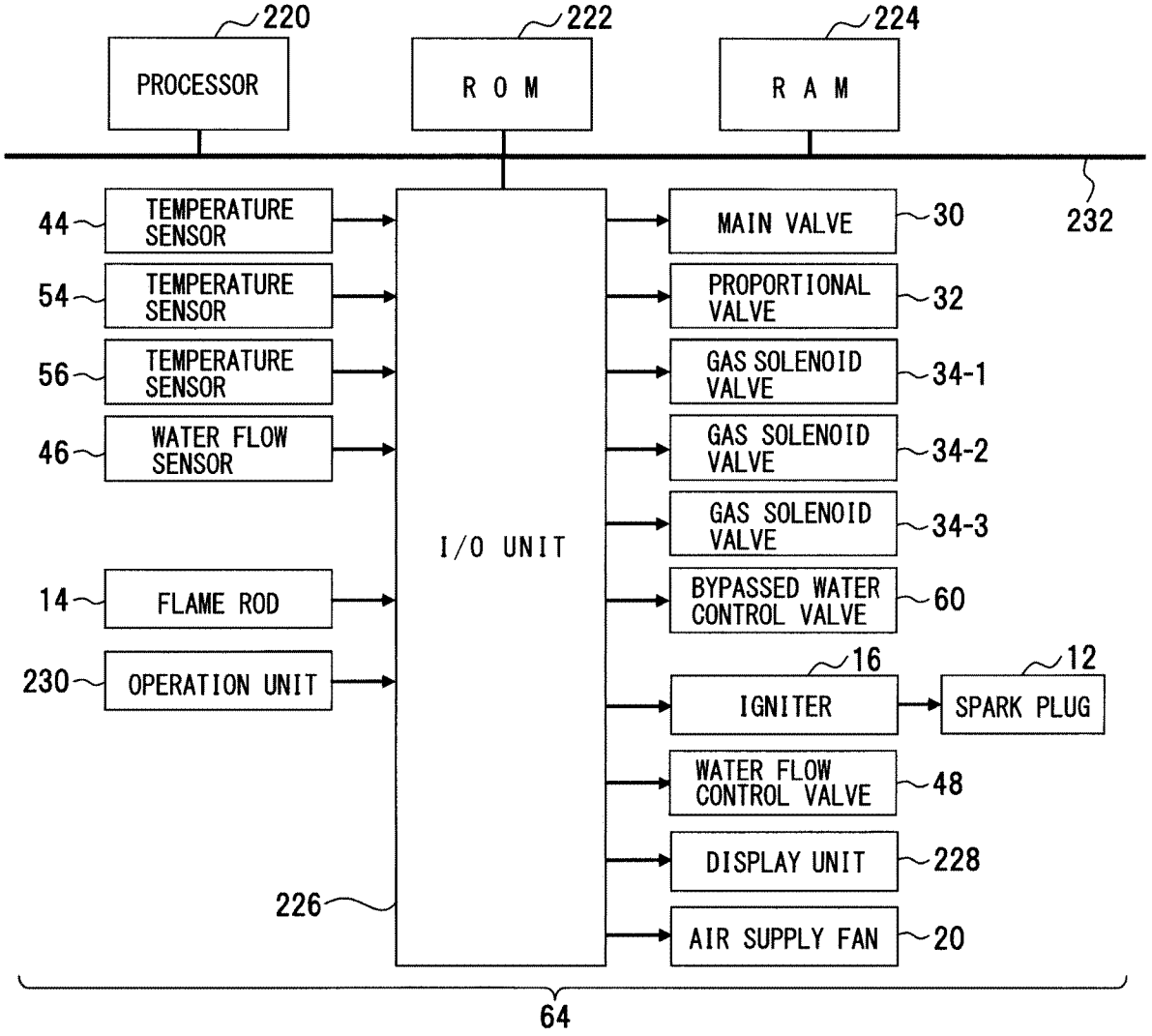
FIG. 20 is a block diagram depicting an example of a water heating control unit.

FIG. 20 depicts an example of the water heating control unit 64. This water heating control unit 64 is configured by computers. As an example, this water heating control unit 64 includes function units such as a processor 220, a ROM (Read-Only Memory) 222, a RAM (Random-Access Memory) 224 and an input/output (I/O) unit 226. The function units are connected with each other by a bus 232.

For example, the processor 220 is configured by CPUs (Central Processing Unit), and executes OSs (Operating System) and water heating control programs in the ROM 222. Detected signals by the flame rod 14, the temperature sensors 44, 54 and 56, and the water flow sensor 46 are referred for this execution. This execution allows the function units such as the main valve 30, the proportional valve 32, the gas solenoid valves 34-1, 34-2 and 34-3, the water flow control valve 48, the bypassed water control valve 60 and the igniter 16 to be controlled. When a remote controller for water heating control is connected, the control of transmission and reception of information with such a remote controller is also executed by the processor 220, which is not depicted.

The ROM 222 stores therein OSs and water heating control programs. Recording media such as semiconductor memory devices are used for this ROM 222. A hard disc drive may be used as a recording medium.

The RAM 224 configures work areas and data storage areas. Readable and writable recording media such as semiconductor memories may be used for this RAM 224. Data may be stored using nonvolatile memories, to be used for control, which is not depicted.

The I/O unit 226 is used for information input and control output. Inputted information includes detected signals by the flame rod 14, the temperature sensors 44, 54 and 56, and water flow sensor 46. Control output includes driving signals and control signals to function units such as the main valve 30, the proportional valve 32, the gas solenoid valves 34-1, 34-2 and 34-3, the water flow control valve 48, the bypassed water control valve 60, the igniter 16 and the air supply fan 20. A display unit 228, an operation unit 230 and the air supply fan 20 are connected to this I/O unit 226.

The display unit 228 is an example of information presentation means that is, in other words, an information presentation device or a display unit. This display unit 228 displays the state of water heating control and information such as input information, output information and guidance information in the form of characters or figures. Operation input is added from the operation unit 230 such as a keyboard to the processor 220.

<Combustion State>

Figure 21A:
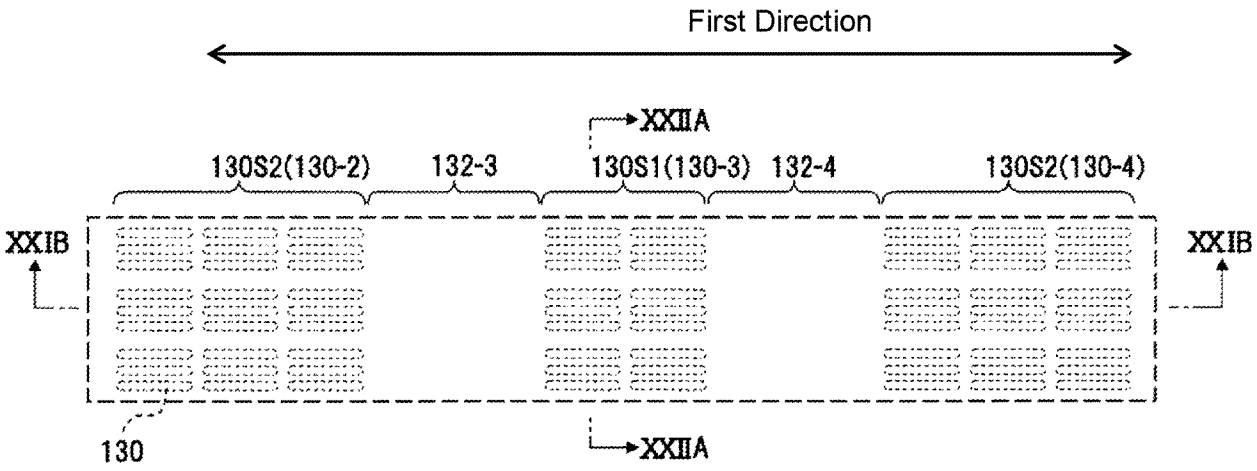
FIGS. 21A and 21B depict a pattern of burner ports and a pattern of combustion.
Figure 21B:
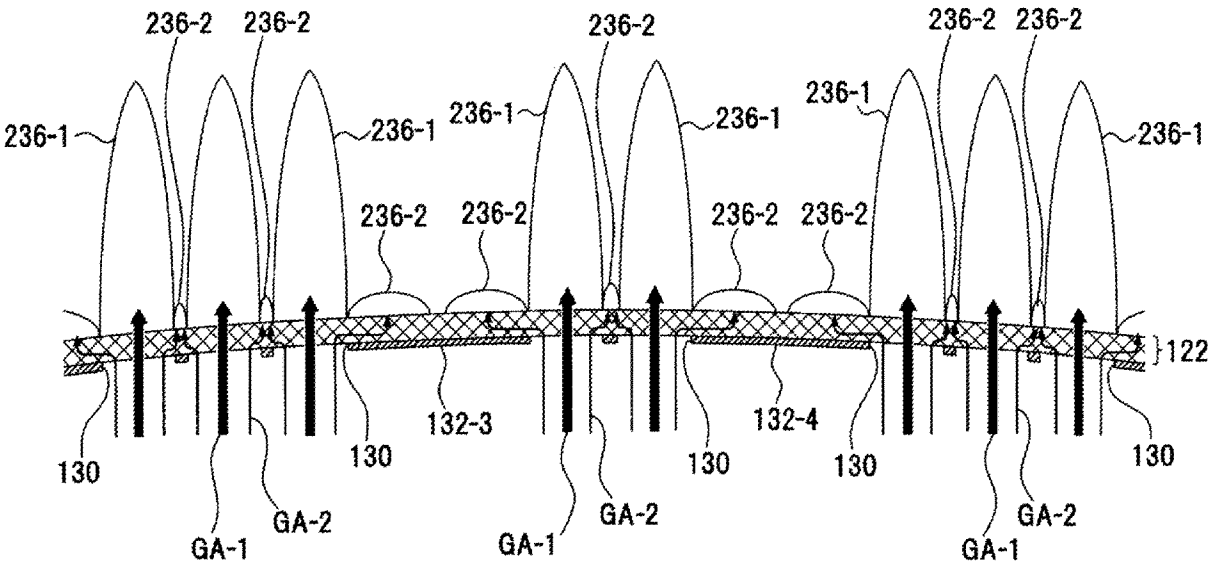
Figure 22A:
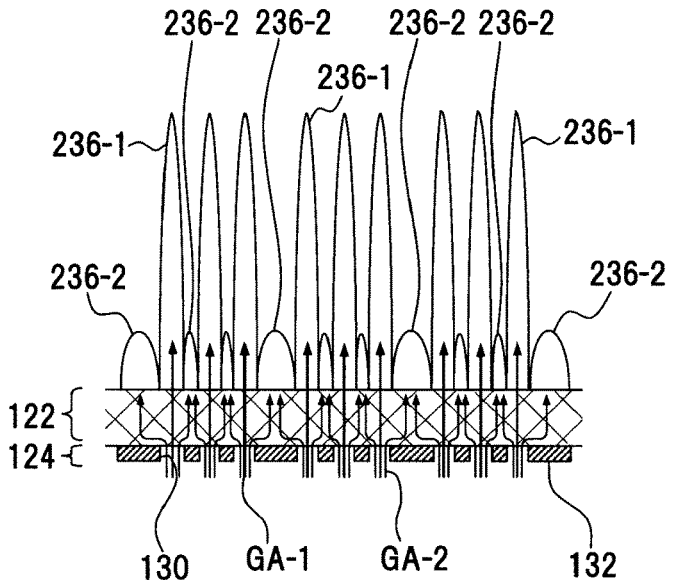
FIGS. 22A to 22C depict the pattern of combustion.

FIG. 21A depicts part of the outlet areas 130-2, 130-3 and 130-4 of the burner 8, which is in the combustion state (XXIA in FIG. 12). FIG. 21B depicts the state of flames in the cross section taken along the line XXIB-XXIB in FIG. 21A. FIG. 22A depicts the state of flames in the cross section taken along the line XXIIA-XXIIA in FIG. 21A.

Parallel flow of the air-fuel mixture GA, which has the constant concentrations, is supplied from the bottom side of the back plate 124 of the burner 8, and the air-fuel mixture GA is ignited. Flames 236 (FIG. 21B) are generated on the top of the metal knit 122.

Two types of flames 236-1 and 236-2 are formed on the top of the metal knit 122 according to the above described outlet pattern. The flame 236-1 is blue flame formed at the outlet 130 that is an opening for high intensity. The flame 236-2 is a holding flame (red flame) to stabilize the flame 236-1 formed at the closed area 132. The flame 236-1 forms a long flame that extends upward from the metal knit 122 according to the flow rate of air-fuel mixture GA-1. On the contrary, the flame 236-2 is a red flame formed in the vicinity of the surface of the metal knit 122 by air-fuel mixture GA-2 of the low flow rate that flows from each outlet 130 into the closed areas 132. The flame 236-2 performs a flame holding function for the flame 236-1. That is, the flame 236-1 is held by the flames 236-2 from the bottom. In this case, the flow rate of the air-fuel mixture GA-2 is decreased by the draft resistance of the metal knit 122.

Figure 22B:
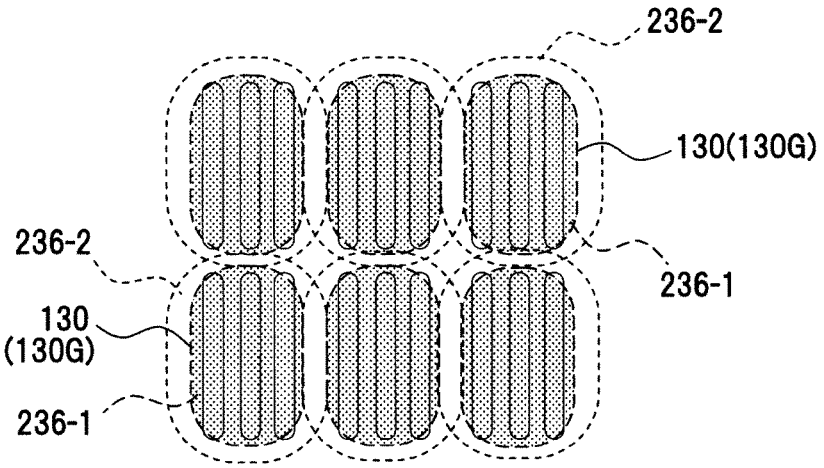

In this case, a group of the flames 236-1, which are gathered by every group of outlet 130G, is formed on the outlets 130 as depicted in FIG. 22B. Each group of flames 236-1 is surrounded to be held by the flames 236-2 that are formed on the clearances P2 and P3.

<Flow of Air-Fuel Mixture 22>

Figure 23:
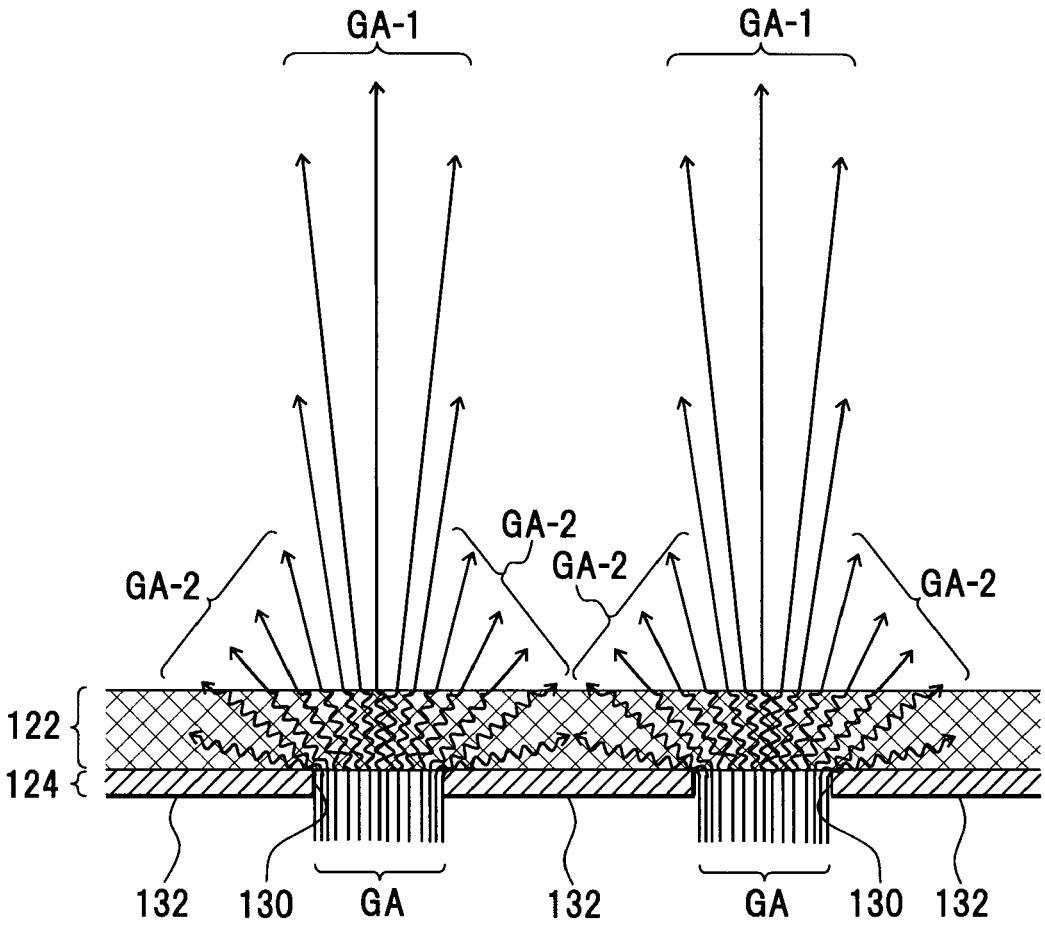
FIG. 23 depicts the flow of an air-fuel mixture that flows through the back plate and the metal knit.

FIG. 23 depicts the flow of the air-fuel mixture GA as to the burner 8. The air-fuel mixture GA that is supplied from the back of the back plate 124 flows out of the outlets 130 in the back plate 124 to the metal knit 122. The air-fuel mixture GA that has passed through the outlets 130 starts to diffuse within the metal knit 122. The air-fuel mixture GA-1 of the high flow rate that passes through the center of each outlet 130 passes through the metal knit 122, to generate a linear mixture stream. On the other hand, the air-fuel mixture GA-2 of the low flow rate that passes through the sides of each outlet 130 diffuses toward the closed part 132, the amount of an air-fuel mixture per unit area (flow rate) is decreased, and the flow rate of the air-fuel mixture GA-2 is further decreased by the draft resistance of the metal knit 122. Like this, the air-fuel mixture GA-2 turns to the top of the closed part 132.

The flames 236-1 of high intensity are formed because the flow-out rate of the air-fuel mixture GA-1 in the outlet 130 side is high. On the contrary, the flames 236-2 of low intensity are formed over the surface of the metal knit 122 to hold the flames 236-1 because the amount of an air-fuel mixture that passes through the metal knit 122 per unit area is small as to the flow-out rate of the air-fuel mixture GA-2 in the closed part 132 side. Flames are stably formed especially in combustion under high intensity (high air ratio). As a result, lifting-off and excess CO emission can be prevented, and the flame holding function of the flames 236-2 realizes the high intensity combustion using the flames 236-1 (flames of high intensity).

<Switching of Combustion>

Figure 24:
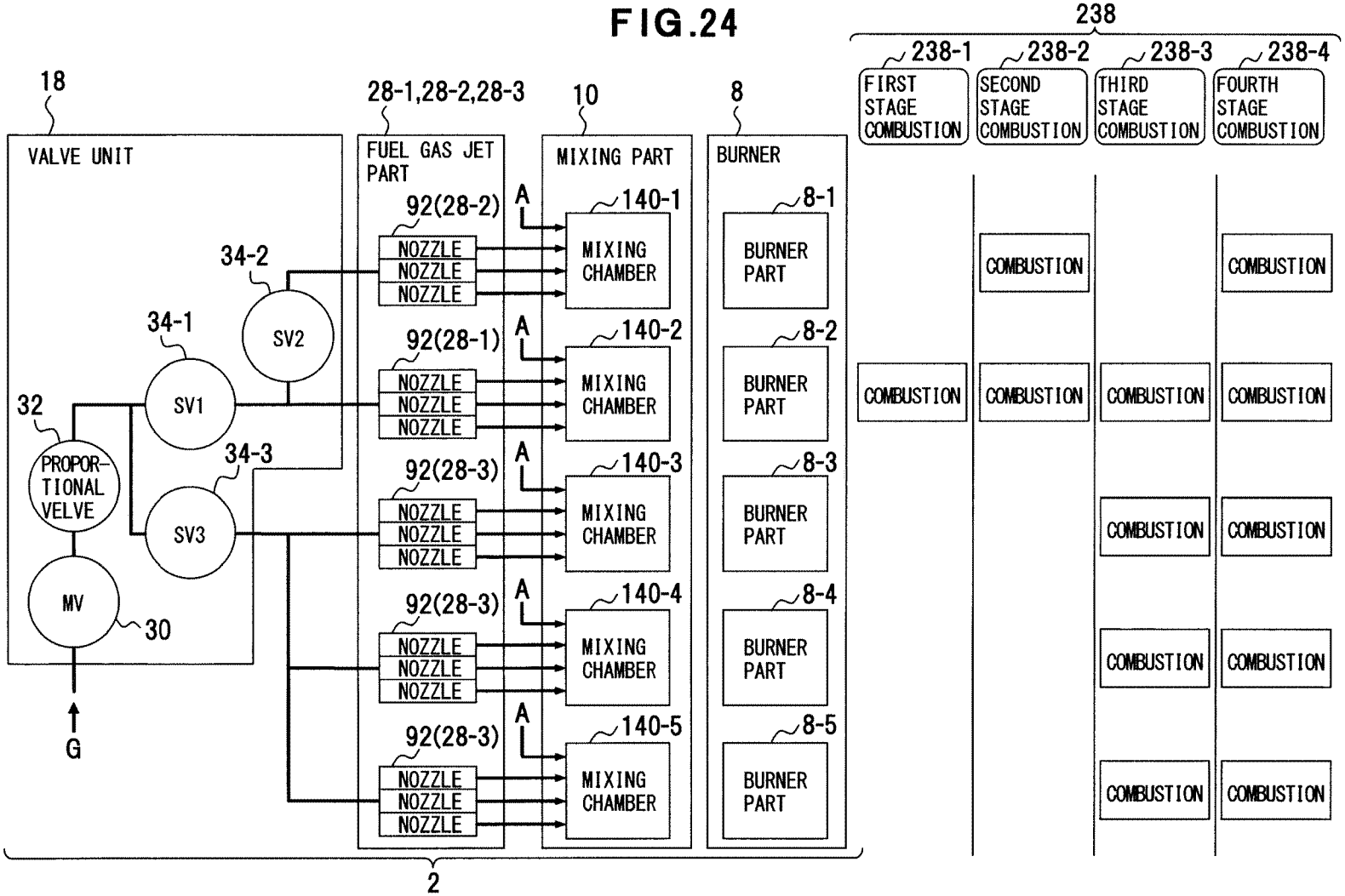
FIG. 24 depicts switching of a stage of combustion.

FIG. 24 depicts generation of a combustion pattern by valve control of the water heater 2. This combustion pattern is an example of switching of combustion. This switching of combustion is selective combustion operation of the burner part 8-1 to the burner part 8-5 of the burner 8 based on the demand for water heating and supply (that is, the amount of supplying hot water). In this case, the combustion pattern 238 includes first stage combustion 238-1, second stage combustion 238-2, third stage combustion 238-3 and fourth stage combustion 238-4.

Water heating and supplying operation is started by opening a hot water faucet of a shower etc. The air supply fan 20 turns when combustion is started. The water heating and supplying operation is started by opening the main valve (MV) 30.

(1) First Stage Combustion (Combustion Only on Burner Part 8-2)

In the first stage combustion, the gas solenoid valve (SV1) 34-1 is opened. Thereby, the fuel gas G is shot from the nozzles 92 of the fuel gas jet part 28-1 to the mixing chamber 140-2. The air supply fan 20 and this intake of the fuel gas G allow the air A to be taken in to the mixing chamber 140-2. The mixing chamber 140-2 mixes the fuel gas G and the air A, to form the air-fuel mixture GA. This air-fuel mixture GA is supplied to the burner part 8-2. The igniter 16 starts to operate, to generate sparks from the spark plug 12. Thereby, the air-fuel mixture GA in the burner part 8-2 is ignited, to start the combustion. This is the first stage combustion 238-1 in the combustion pattern 238. This first stage combustion is performed by the burner part 8-2. The state of this combustion is as described in the above. The amount of combustion of the air-fuel mixture GA in the burner part 8-2 is proportional to the supply of the fuel gas G by the proportional valve 32. The supply of the fuel gas G varies according to the demand for water heating and supply. Only the air A is taken in to the mixing chambers other than the mixing chamber 140-2.

(2) Second Stage Combustion (Combustion on Burner Parts 8-1 and 8-2)

In the second stage combustion, the gas solenoid valves 34-1 and 34-2 are opened. The fuel gas G is shot from the nozzles 92 of the fuel gas jet part 28-2 to the mixing chamber 140-1. The air supply fan 20 and this intake of the fuel gas G allow the air A to be taken in to the mixing chamber 140-1. The mixing chamber 140-1 mixes the fuel gas G and the air A, to form the air-fuel mixture GA. This air-fuel mixture GA is supplied to the burner part 8-1. Thereby, the combustion transitions to the second stage combustion 238-2 that is combustion by the burner part 8-1 in addition to the burner part 8-2. The amount of combustion of the air-fuel mixture GA in the burner parts 8-1 and 8-2 is proportional to the supply of the fuel gas G by the proportional valve 32. The supply of the fuel gas G varies according to the demand for water heating and supply as well in this case. Only the air A is taken in to the mixing chambers other than the mixing chambers 140-1 and 140-2.

(3) Third Stage Combustion (Combustion on Burner Parts 8-2 to 8-5)

In the third stage combustion, the gas solenoid valve 34-2 is closed and the gas solenoid valves 34-1 and 34-3 are opened. In this case, while the burner part 8-1 is in an extinguished state, the gas solenoid valve 34-1 is kept opened in order to maintain the combustion, and the burner part 8-2 continues to be in the combusting state. The fuel gas G is shot from the nozzles 92 of each fuel gas jet part 28-3 to the mixing chambers 140-3, 140-4 and 140-5 respectively. The air supply fan 20 and this intake of the fuel gas G allow the air A to be taken in to the mixing chambers 140-3, 140-4 and 140-5. The mixing chambers 140-3, 140-4 and 140-5 mix the fuel gas G and the air A, to form the air-fuel mixture GA. This air-fuel mixture GA is supplied to the burner parts 8-3, 8-4 and 8-5. Thereby, the combustion transitions to the third stage combustion 238-3 that is combustion by the burner parts 8-3, 8-4 and 8-5 in addition to the burner part 8-2. The amount of combustion of the air-fuel mixture GA in the burner parts 8-2, 8-3, 8-4 and 8-5 is proportional to the supply of the fuel gas G by the proportional valve 32. The supply of the fuel gas G varies according to the demand for water heating and supply as well in this case. Only the air A is taken in to the mixing chamber other than the mixing chambers 140-2, 140-3, 140-4 and 140-5.

(4) Fourth Stage Combustion (Combustion on all Burner Parts 8-1, 8-2, 8-3, 8-4 and 8-5)

In the fourth stage combustion, the gas solenoid valve 34-2, which has been closed in the third stage combustion, is opened. The fuel gas G flowing out of the burner part 8-1, which has been extinguished, is ignited. Thereby, the combustion transitions to the fourth stage combustion 238-4 that is combustion by the burner part 8-1 in addition to the third stage combustion. The amount of combustion of the air-fuel mixture GA in the burner parts 8-1, 8-2, 8-3, 8-4 and 8-5 is proportional to the supply of the fuel gas G by the proportional valve 32. The supply of the fuel gas G varies according to the demand for water heating and supply as well in this case.

(5) Number of Stage of Combustion for Demand for Water Heating and Supply

Figure 25:
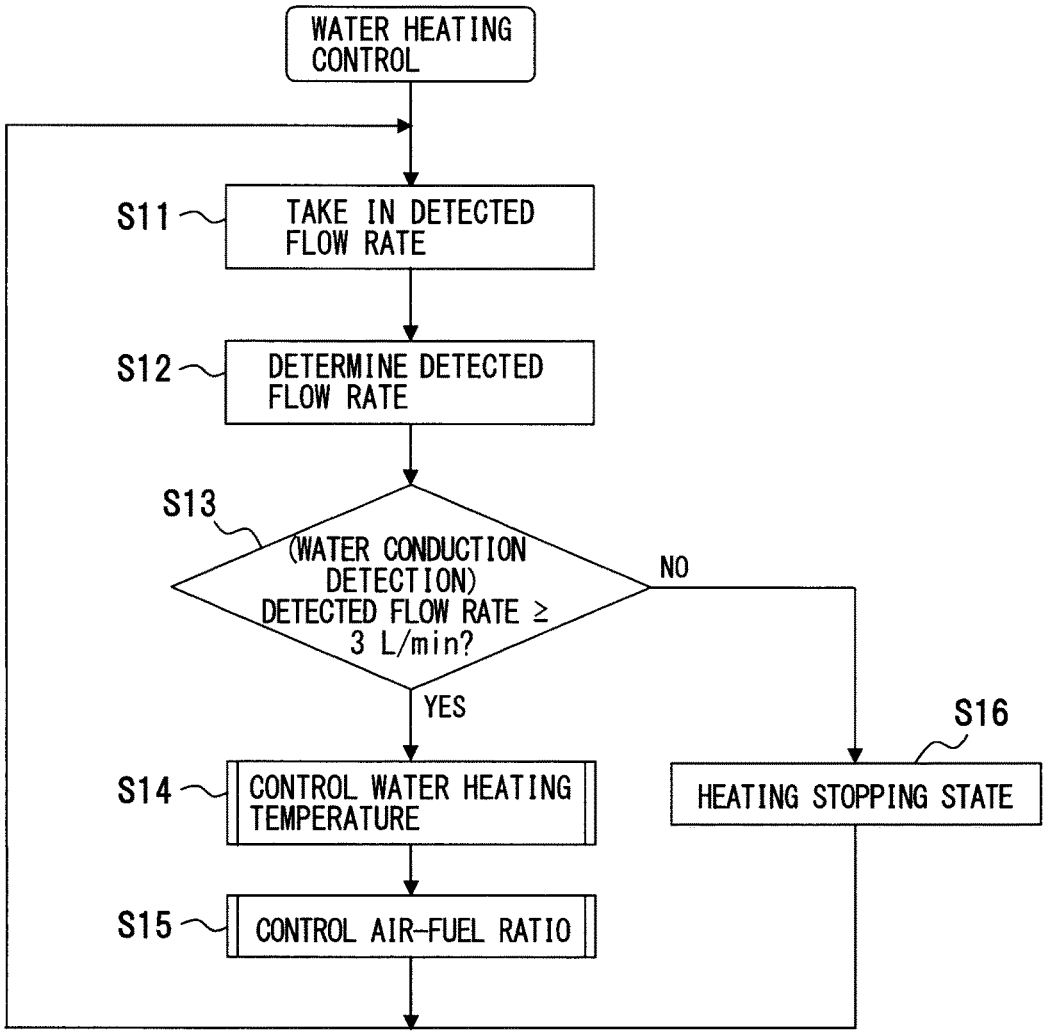
FIG. 25 is a flowchart depicting an example of procedures for water heating control of the water heater.

FIG. 25 depicts an example of procedures for water heating control of the water heater 2.

These procedures are an example of the combustion control method of the present invention. In these procedures, the flow rate, which is detected, is taken in (S11). This detected flow rate is a detected value by the water flow sensor 46. This detected flow rate is determined (S12). In this determination of the detected flow rate, water conduction is detected. In this detection of water conduction, it is determined if the detected flow rate is equal to or over a predetermined value, for example, 3 L/min (Liter per minute).

If the detected flow rate is equal to or over 3 L/min (YES of S13), water heating temperature is controlled (S14), and the air-fuel ratio is controlled (S15). In the control of water heating temperature, the amount of combustion is adjusted, and a stage of the combustion is switched as the adjustment of the amount of the combustion. In the control of the air-fuel ratio, the air supply is adjusted based on monitoring of flames.

In S13, if the detected flow rate is smaller than 3 L/min (NO of S13), control is executed so as to bring a heating stopping state (S16).

Figure 26:
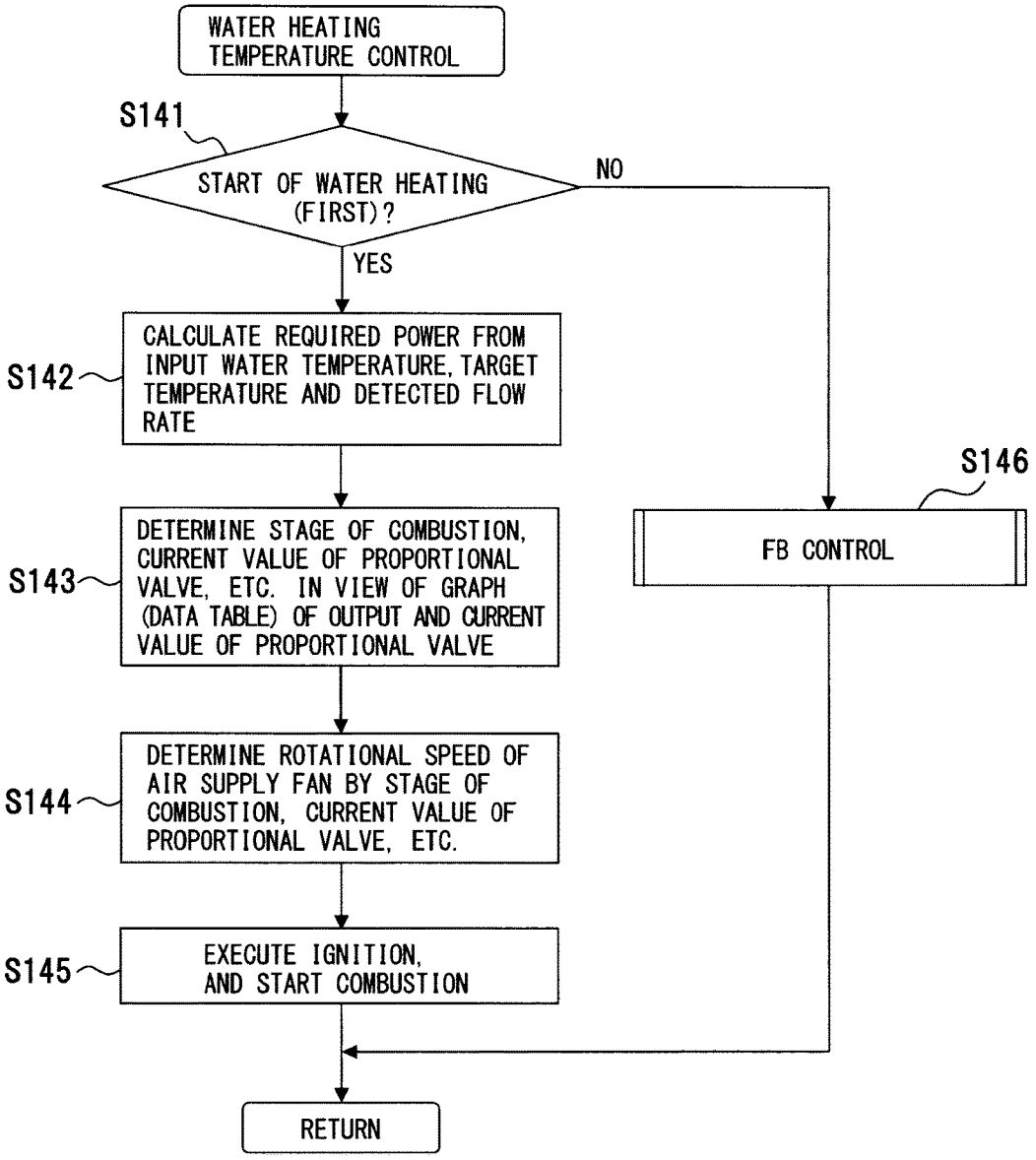
FIG. 26 is a flowchart depicting an example of procedures for water heating temperature control.
Figure 27:
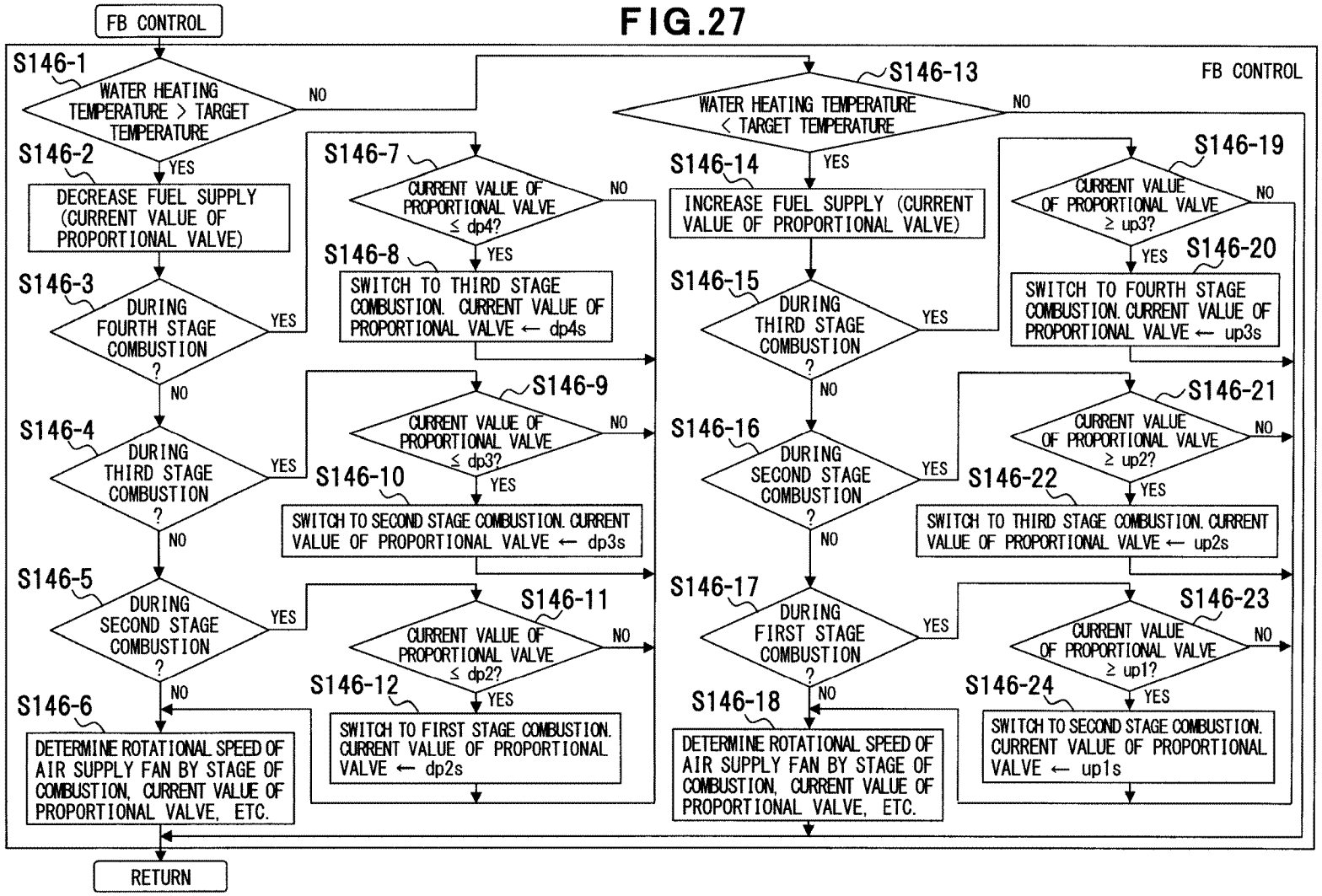
FIG. 27 is a flowchart depicting an example of procedures for the water heating temperature control (feedback control)

FIGS. 26 and 27 depict an example of procedures for the water heating temperature control (S14).

In the procedures for the water heating temperature control (S14: FIG. 25), it is determined whether to be the start of water heating first (S141). If the start of water heating is determined (YES of S141), required power is calculated from input water temperature, target temperature and the detected flow rate (S142).

Information on the relationship between the output and the current value of a proportional valve is referred to, and a stage of the combustion, a current value of a proportional valve, etc. are determined (S143). For the information on the relationship between the output and the current value of a proportional valve, for example, a data table is created in advance as a relational graph for the output and the current value of a proportional valve, and this data table may be referred to.

The rotational speed of an air supply fan is determined by the stage of the combustion, the current value of a proportional valve, etc. (S144). After this determination, ignition is executed, and the combustion is started (S145).

If the combustion has been started already (NO of S141), FB (feedback) control is executed (S146).

The FB control (S146) is executed by the procedures depicted in FIG. 27, for example.

In these procedures, water heating temperature is compared to target temperature, to check if the water heating temperature is higher than the target temperature (S146-1). If the water heating temperature is higher than the target temperature (YES of S146-1), the fuel supply (current value of a proportional valve) is decreased (S146-2).

Whether to be in the fourth stage combustion is determined (S146-3). If the combustion is not in the fourth stage combustion (NO of S146-3), whether to be in the third stage combustion is determined (S146-4). If the combustion is not in the third stage combustion (NO of S146-4), whether to be in the second stage combustion is determined (S146-5). If the combustion is not in the second stage combustion (NO of S146-5), the rotational speed of an air supply fan is determined by a stage of the combustion, the current value of a proportional valve, etc. (S146-6), and the procedures return to S146 (FIG. 26).

In S146-3, if the combustion is in the fourth stage combustion (YES of 146-3), it is determined whether the current value of a proportional valve is equal to or smaller than dp4 (FIG. 28) (S146-7). If the current value of a proportional valve is equal to or smaller than dp4 (YES of S146-7), the combustion is switched to the third stage combustion, the current value of a proportional valve is increased to dp4s (S146-8), and the procedures move to S146-6. In S146-7, if the current value of a proportional valve is not equal to or smaller than dp4 (NO of S146-7), S146-8 is skipped and the procedures move to S146-6.

In S146-4, if the combustion is in the third stage combustion (YES of 146-4), it is determined whether the current value of a proportional valve is equal to or smaller than dp3 (FIG. 28) (S146-9). If the current value of a proportional valve is equal to or smaller than dp3 (YES of S146-9), the combustion is switched to the second stage combustion, the current value of a proportional valve is increased to dp3s (S146-10), and the procedures move to S146-6. In S146-9, if the current value of a proportional valve is not equal to or smaller than dp3 (NO of S146-9), S146-10 is skipped and the procedures move to S146-6.

In S146-5, if the combustion is in the second stage combustion (YES of 146-5), it is determined whether the current value of a proportional valve is equal to or smaller than dp2 (FIG. 28) (S146-11). If the current value of a proportional valve is equal to or smaller than dp2 (YES of S146-11), the combustion is switched to the first stage combustion, the current value of a proportional valve is increased to dp2s (S146-12), and the procedures move to S146-6. In S146-11, if the current value of a proportional valve is not equal to or smaller than dp2 (NO of S146-11), S146-12 is skipped and the procedures move to S146-6.

In S146-1, if the water heating temperature is not larger than the target temperature (NO of S146-1), it is determined if the water heating temperature is smaller than the target temperature (S146-13). If the water heating temperature is smaller than the target temperature (YES of S146-13), the fuel supply (current value of a proportional valve) is increased (S146-14).

Whether to be in the third stage combustion is determined (S146-15). If the combustion is not in the third stage combustion (NO of S146-15), whether to be in the second stage combustion is determined (S146-16). If the combustion is not in the second stage combustion (NO of S146-16), whether to be in the first stage combustion is determined (S146-17). If the combustion is not in the first stage combustion (NO of S146-17), the rotational speed of an air supply fan is determined by a stage of combustion, the current value of a proportional valve, etc. (S146-18), and the procedures return to S146 (FIG. 26).

In S146-15, if the combustion is in the third stage combustion (YES of 146-15), it is determined whether the current value of a proportional valve is equal to or larger than up3 (FIG. 28) (S146-19). If the current value of a proportional valve is equal to or larger than up3 (YES of S146-19), the combustion is switched to the fourth stage combustion, the current value of a proportional valve is decreased to up3s (S146-20), and the procedures move to S146-18. In S146-19, if the current value of a proportional valve is not equal to or larger than up3 (NO of S146-19), S146-20 is skipped and the procedures move to S146-18.

In S146-16, if the combustion is in the second stage combustion (YES of 146-16), it is determined whether the current value of a proportional valve is equal to or larger than up2 (FIG. 28) (S146-21). If the current value of a proportional valve is equal to or larger than up2 (YES of S146-21), the combustion is switched to the third stage combustion, the current value of a proportional valve is decreased to up2s (S146-22), and the procedures move to S146-18. In S146-21, if the current value of a proportional valve is not equal to or larger than up2 (NO of S146-21), S146-22 is skipped and the procedures move to S146-18.

In S146-17, if the combustion is in the first stage combustion (YES of S146-17), it is determined whether the current value of a proportional valve is equal to or larger than up1 (FIG. 28) (S146-23). If the current value of a proportional valve is equal to or larger than up1 (YES of S146-23), the combustion is switched to the second stage combustion, the current value of a proportional valve is decreased to up1s (S146-24), and the procedures move to S146-18. In S146-23, if the current value of a proportional valve is not equal to or larger than up1 (NO of S146-21), S146-24 is skipped and the procedures move to S146-18.

Figure 28:
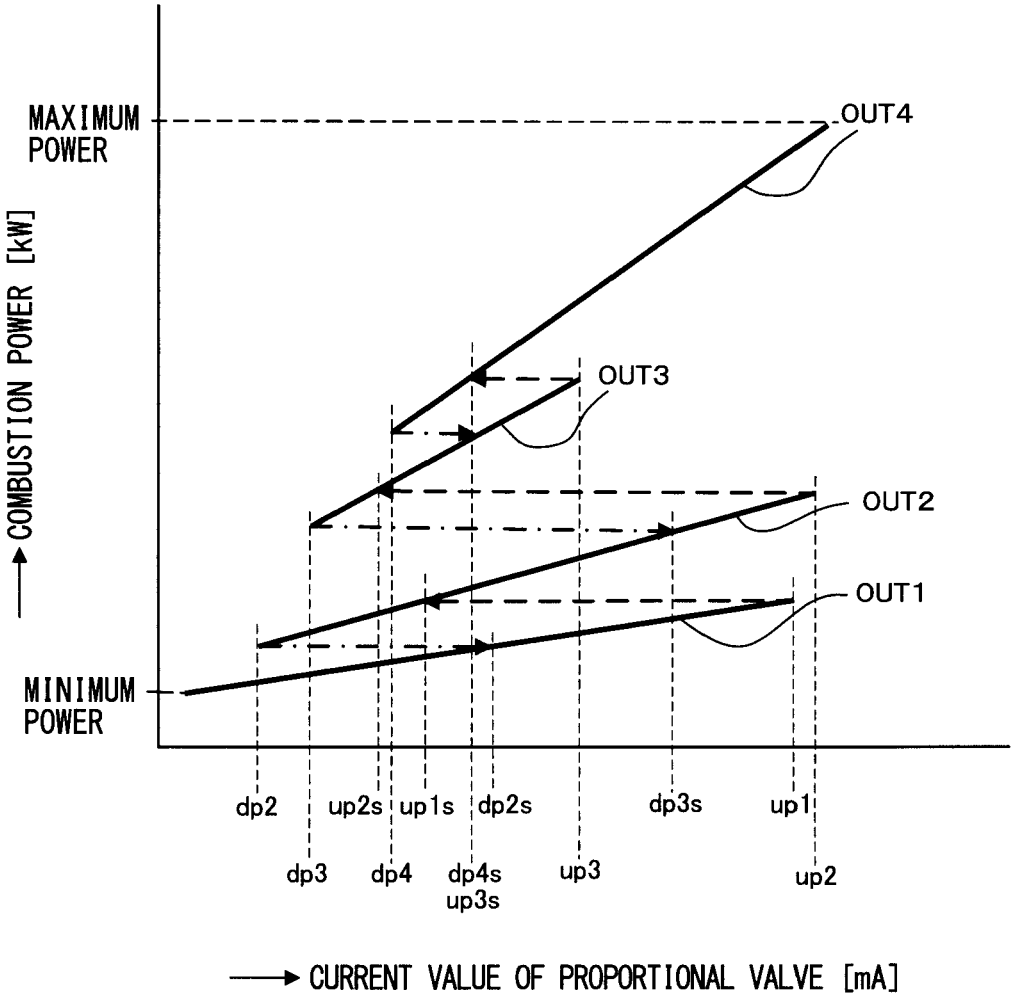
FIG. 28 depicts the relationship between combustion power and a current value of a proportional valve in the switching of a stage of combustion.

FIG. 28 depicts the relationship between combustion power and a current value of a proportional valve in the switching of a stage of combustion. A current value of a proportional valve (mA) is represented by the horizontal axis, and output (kW) as combustion power is represented by the vertical axis. For example, the proportional valve 32 is constituted by a solenoid valve. The opening degree of this proportional valve 32 is proportional to an input current (current of a proportional valve) value (mA). In FIG. 28, OUT1 represents the output range of the first stage combustion, OUT2 represents the output range of the second stage combustion, OUT3 represents the output range of the third stage combustion, and OUT4 represents the output range of the fourth stage combustion.

Under such output ranges, the opening degree of the proportional valve 32 is continuously controlled by a current value of a proportional valve (mA) according to the demand for water heating and supply. In case of deviation from the aforementioned control range, a stage is switched (increased or decreased) within the range of OUT1 to OUT4. If the demand for water heating and supply is over the range of OUT4, OUT4 is kept. If the demand for water heating and supply is below the range of OUT1, the extinguished state is brought.

Like the above, the switching of a stage of combustion and the current of a proportional valve adjust combustion power in the water heating temperature control.

When a stage of combustion is increased, a current value of a proportional valve is switched from up1 to up1s, from up2 to up2s or from up3 to up3s. When a stage of combustion is decreased, a current value of a proportional valve is switched from dp4 to dp4s, from dp3 to dp3s or from dp2 to dp2s. The combustion power is adjusted in the range of the minimum power and the maximum power while such switching is executed.

Figure 29:
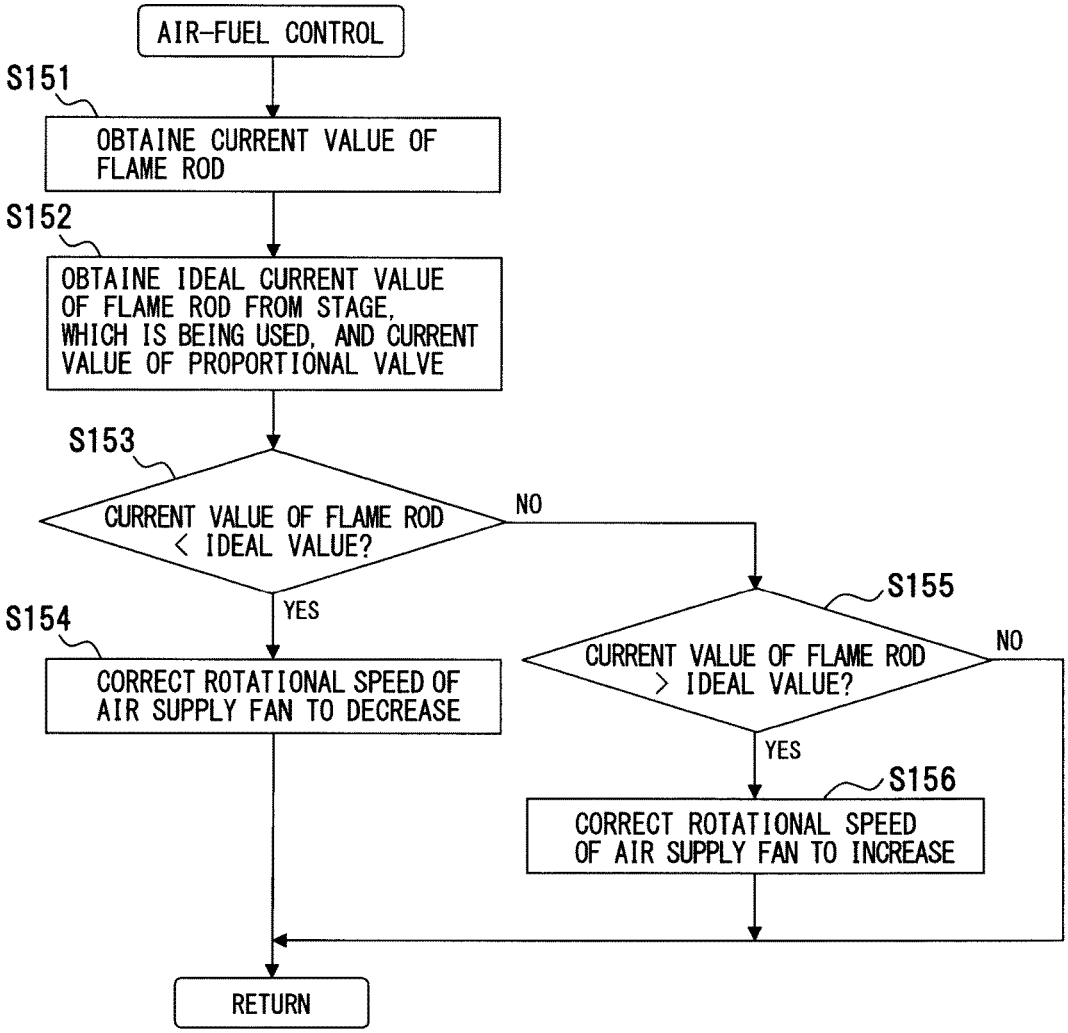
FIG. 29 is a flowchart depicting an example of procedures for air-fuel ratio control.

FIG. 29 depicts procedures for the air-fuel ratio control (S15: FIG. 25).

In this air-fuel ration control, the air supply is adjusted based on monitoring of flames. In these procedures, the current value of a flame rod is obtained (S151), and an ideal current value IA (FIG. 30B) of a flame rod is obtained from a stage, which is being used, and the current value of a proportional value (S152).

As to this current value of a flame rod, it is determined if the current value of a flame rod is smaller than the ideal value (S153). If the current value of a flame rod is smaller than the ideal value (YES of S153), the rotational speed of an air supply fan is corrected to be decreased (S154), and the procedures return to S15 (FIG. 25).

In S153, if the current value of a flame rod is not smaller than the ideal value (NO of S153), it is determined if the current value of a flame rod is larger than the ideal value (S155). If the current value of a flame rod is larger than the ideal value (YES of S155), the rotational speed of an air supply fan is corrected to be increased (S156), and the procedures return to S15 (FIG. 25).

Figure 30A:
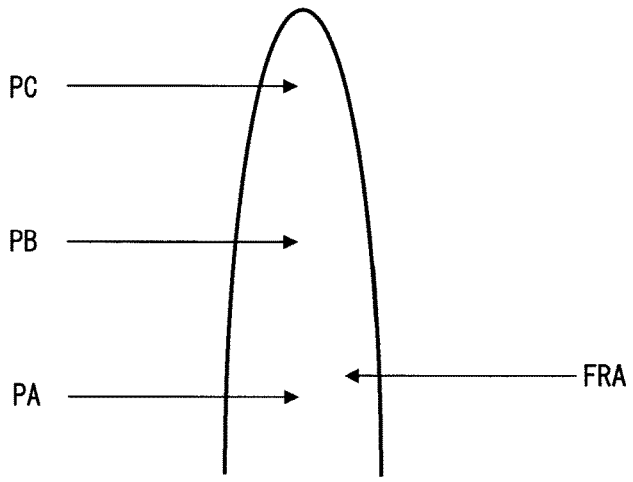
FIGS. 30A and 30B depict change in the shape and current value of a flame in the air-fuel ratio control.
Figure 30B:
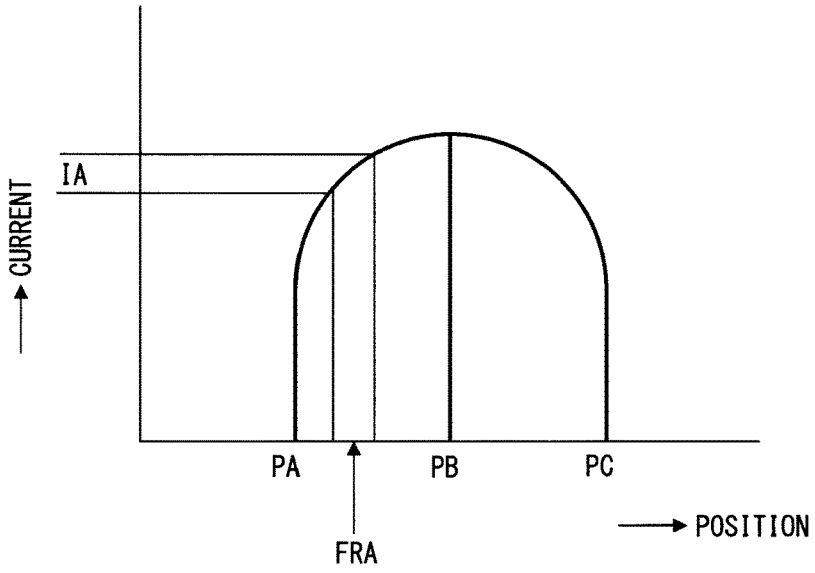

FIGS. 30A and 30B depict change in the shape, and a current value of a flame in the air-fuel ratio control. The current value near the center of a flame (PB) is the maximum, and decreases at each position of PA and PC of this flame. That is, the further from the center of a flame a position is, the more a current value at this position decreases. Therefore, change in the shape of a flame can be detected through a current value because the position of the flame rod 14, that is, FRA does not change. In short, when a flame becomes smaller and PB approaches FRA, a current value becomes larger. In contrast, when a flame becomes larger and PB moves away from FRA, a current value becomes smaller. Such control is executed that if a current value is larger than an ideal value, the rotational speed of a fan is increased, and if the current value is smaller than the ideal value, the rotational speed of a fan is decreased.

An ideal shape of a flame varies according to the amount of combustion (stage of combustion and a current value of a proportional value), and an ideal current value of a flame rod also varies. Thus, data of an ideal current value is prepared for every stage of combustion and current value of a proportional value, and then a present state of a current value for the ideal value is detected to correct the rotational speed of a fan. Thereby, the shape of a flame can be controlled into an ideal state.

<Air Ratio in Combustion Field and Combustion Intensity>

Figure 31:
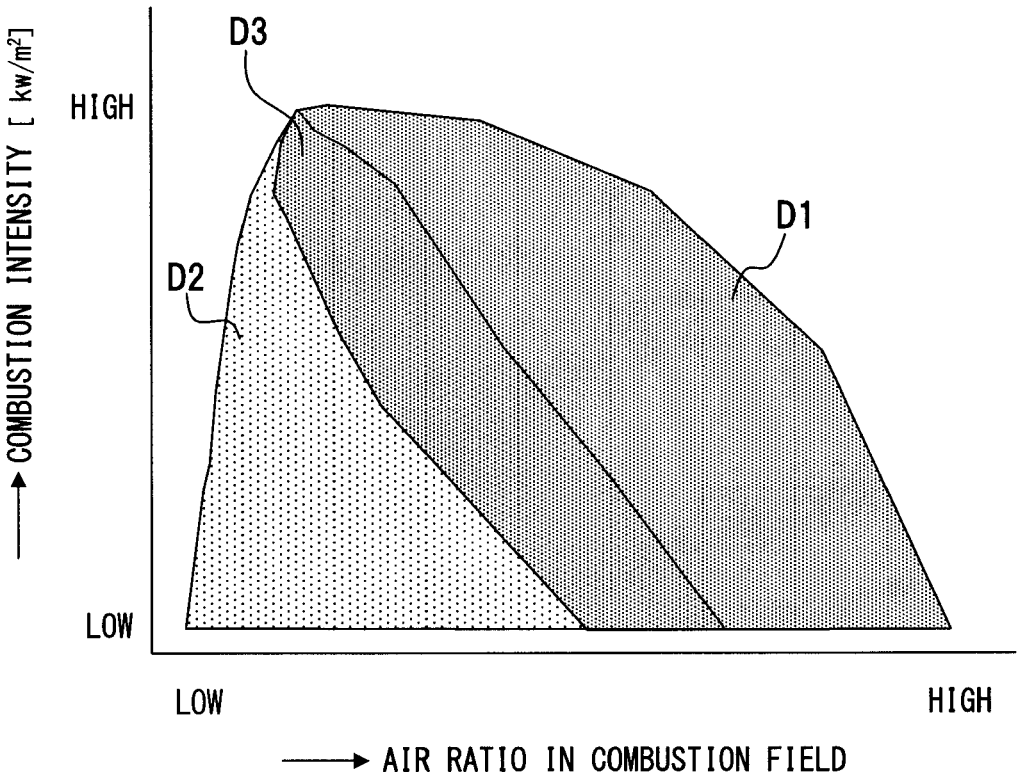
FIG. 31 depicts the characteristics of combustion intensity for the air ratio.

FIG. 31 depicts a combustion mode through the air ratio in a combustion field (horizontal axis) and the combustion intensity (kW/m$^2$) (vertical axis). In FIG. 31, D1 is a blue flame mode, D2 is a red heat mode, and D3 is a neutral mode. D1 occurs in the range of middle and high in each stage of combustion. D2 occurs in the low range in each stage of combustion.

When the air-fuel mixture GA combusts on the burner 8, a combustion field is formed on the surface of the metal knit 122. The air-fuel mixture GA is supplied to this combustion field as long as combustion is continued. The amount of air per the amount of this air-fuel mixture is the air ratio. This air ratio may be the amount of the air per the amount of fuel. A width of the practicable air ratio is determined according to the combustion intensity. This combustion intensity is defined by combustion output (kW) per unit area (m$^2$).

It can be said from this graph depicted in FIG. 31 that when the air ratio is low, the red heat mode is maintained and as the air ratio gets higher, a mode tends to be the blue flame mode when the combustion intensity becomes high. In the red heat mode, combustion energy turns radiant heat transfer in addition to convective heat transfer. On the contrary, in the blue flame mode, almost all the combustion energy turns convective heat transfer. The amount of supplied fuel gas is the same under the same combustion intensity. Thus, the higher the air ratio is, the faster the flow of an air-fuel mixture is.

It is necessary for the burner 8 and the water heater 2 that uses the burner 8 to obtain high output from the limited combustion area. Therefore, high intensity combustion is required. The use of radiant heat transfer is limited because of the structure of the heat exchanger 38. Thus, the blue flame mode in which convective heat transfer often occurs is effective.

<Concentration of CO for Air Ratio>

Figure 32:
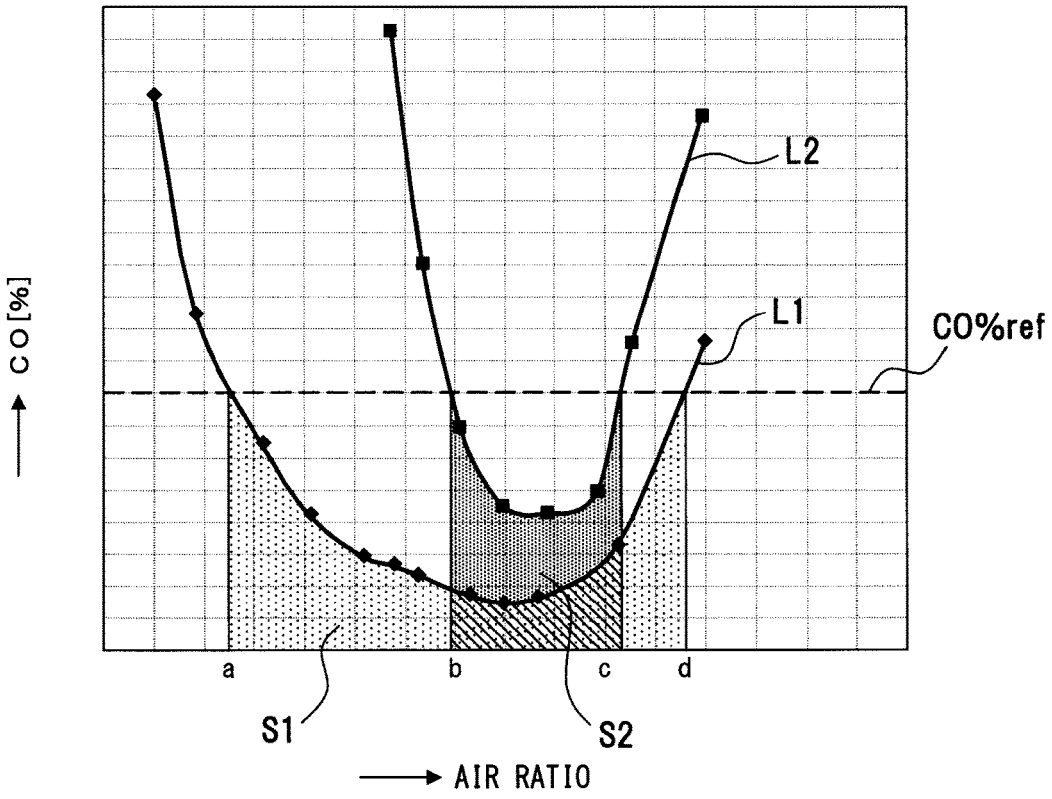
FIG. 32 depicts the relationship between the air ratio and carbon monoxide.

FIG. 32 depicts change in the concentration of CO (carbon monoxide) (%) for the air ratio. The horizontal axis represents the air ratio and the vertical axis represents CO (%). L1 represents the combustion characteristics of the burner 8 when the flame holding function by red heat flames is given, and L2 represents the combustion characteristics when no flame holding function is given. That is, FIG. 32 represents change in the air ratio and CO % in the presence and absence of the flame holding function under the output of the fixed power.

It will be described below that when the flame holding function is given, the wide range of the air ratio can be taken, and stable combustion using blue flames can be carried out (FIG. 22C), In these combustion characteristics, the air ratios a, b, c and d are obtained from the limits of combustion available areas S1 (L1) and S2 (L2) that meet the value of the concentration of CO (CO % reference) for the inspection for gas appliances in the United States, COref (here, COref<0.04). The relationship between the air ratios a, b, c and d is: a<b<c<d. As a result, while b<air ratio<c in the combustion available area S2, a<air ratio<d in the combustion available area S1 of the burner 8. Thus, the combustion available area is much more improved in the combustion available area S1. In short, the wide range can be set for a value of the air ratio in the burner 8.

<Effects of Embodiment>

(a) According to the burner 8, the air-fuel mixture GA of the uniform mixture ratio of the fuel gas G and the air A can be obtained.

(b) The mixture ratio of the fuel gas G and the air A can be stabilized, and stable combusting flames can be obtained.

(c) The burner 8 consists of the burner frame 106, the metal knit 122 and the back plate 124. The back plate 124 constitutes a flow adjustment means that is, in other words, a flow adjustment device or a flow adjuster. The outlet pattern on the back plate 124 constitutes the outlets 130 that are openings for high intensity, and the closed part 132 for holding flames.

(d) The flow-out rate of the air-fuel mixture GA-1 through the outlets 130 and the groups of outlets 130G is high, to bring high intensity combustion. Thus, the flames 236-1 of blue flames can be generated. On the contrary, the flames 236-2 that surround the flames 236-1 are formed on the closed part 132. The flow-out rate of the air-fuel mixture GA-2 that forms these flames 236-2 is lower than the air-fuel mixture GA-1, to bring low intensity combustion (red heat combustion). That is, the flames 236-2 are formed around the base of the flames 236-1 (surface of the metal knit 122). The flames 236-2 function as flame holding for the flames 236-1. Thus, lifting-off of the flames 236-1 can be prevented from occurring, to avoid extinction of the flames 236-1. Therefore, high intensity combustion using the air-fuel mixture GA-1 of the high flow-out rate can be kept, in addition to using the flame holding function of the flames 236-2.

(e) The air-fuel mixture GA-2 from the outlets 130 is generated on the closed part 132. This air-fuel mixture GA-2 is generated by leaks of the air-fuel mixture GA. This air-fuel mixture GA-2 shoots through the metal knit 122 over the closed part 132. Thus, the flow-out rate of the air-fuel mixture GA-2 is low, and the flames 236-2 is generated along the surface of the metal knit 122. Thereby, the metal knit 122 is heated, and a high temperature field is formed on the metal knit 122. In this high temperature field, the metal knit 122 is in a red heat state. The flames 236-1 by the air-fuel mixture GA-1 are formed over the metal knit 122, where this red heat state is maintained. As a result, the red heat state of the metal knit 122 and the flames 236-2 by the air-fuel mixture GA-2 function as holding the flames 236-1. That is, stable combustion of the flames 236-1 is kept by the flames 236-2.

(f) The flow-out rates of the air-fuel mixture GA-1 and GA-2 are controlled by the pattern of the outlets 130 and the closed part 132 on the back plate 124 that is the flow adjustment means. That is, the back plate 124 controls combustion intensity. Thereby, high intensity combustion can be maintained by flame holding, and stable high intensity combustion can be obtained.

(g) The flames 236-1 by the groups of outlets 130G is surrounded by the flames 236-2 that are holding flames (FIG. 22B). Stable high intensity combustion can be maintained for the flames 236-1 on every group of outlet 130G.

(h) The flame holding function of red flames can increase the practicable maximum output of the burner 8. Whether this maximum output can be used or not is determined according to CO %, nitric oxide (NOx) %, and the stability (lifting-off) of flames. While 58 kW is obtained for the maximum output of the burner 8 when the flame holding function is given, the practicable maximum output when the flame holding function by the closed part 132 is not given is limited to 30 kW. That is, giving the flame holding function by the closed part 132 can increase combustion intensity twice as much.

Figure 22C:
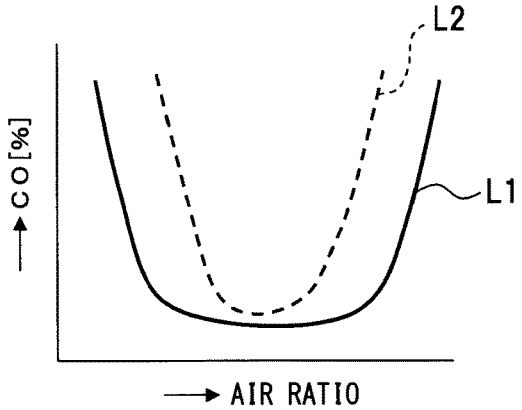

(i) When the relationship between the air ratio and CO (%) is viewed as to the flame holding function of red flames, the characteristics L1 and L2 are obtained according to the presence of the flame holding function as depicted in FIG. 22C. The characteristics L1 is high intensity combustion characteristics by the flame holding function, and the characteristics L2 is high intensity combustion characteristics when the flame holding function is not given. When no flame holding function is given, CO % increases as the width of the air ratio is widened like the characteristics L2, the stability in the high output range and combustion performance is lacked, and the available range of the width of the air ratio narrows. On the contrary, when the flame holding function is given, CO emission is a little even if the width of the air ratio is widened like the response L1, and then the wide width of the air ratio can be used.

(j) High intensity combustion of the burner 8 can be obtained by improvement of the flame holding function.

(k) High intensity combustion of the burner 8 can be obtained by the above described improvement of the flame holding function. Thus, compact burners are available and combustion chambers can be made to be small.

(l) The width of the air ratio, which can be used, can be widened since the flame holding function is improved, and stable high intensity combustion can be obtained from the decrease of the occurrence of lifting-off of flames.

(m) The emission of CO and NOx can be held down, to contribute to the decrease of the environmental impacts because the flame holding function is improved and stable high intensity combustion can be maintained.

(n) In the water heater 2, blue flame combustion is obtained from the burner 8 and red heat flames are used for the flame holding function. Thus, the burner 8 can be made to be small by the high efficiency. Thereby, the volume of a combustion system, which includes the burner 8, accounting for the water heater 2 can be reduced, and the water heater 2 can be made to be small and can be lightweighted.

(o) The reduction of CO and NOx can be achieved by blue flame combustion, and the water heater 2 of high safety can be obtained.

Other Embodiments (1) The above embodiment illustrates the water heater 2 that uses the burner 8. A heat source device that uses the burner 8 is not limited to a water heater. A heat source device may be a heating or a cooker.

(2) In the above embodiment, the air-fuel mixture GA, which is supplied from the mixing part 10 to the burner 8, is parallel flow of the constant or almost constant concentrations. The air ratio of the air-fuel mixture GA and the amount of fuel gas may be different between mixing chambers.

(3) In the above embodiment, the burner 8 is horizontally disposed. The burner 8 may be disposed vertically or obliquely.

(4) A single burner 8 constitutes a plurality of the burner parts 8-1, 8-2, 8-3, 8-4 and 8-5 that are individual. In the above embodiment, five burner parts are constituted. Burner parts may be less than five, or more than five. The least burner part(s) 8 that combust(s) the air-fuel mixture GA may be one, or may be plural.

(5) The burner 8 includes a plurality of the air-fuel mixture outlets 130. The burner 8 may be constituted by one air-fuel mixture outlet 130.

According to the burner, the combustion apparatus, the method for combustion, the method for controlling combustion, the recording medium and the water heater disclosed in "DETAILED DESCRIPTION OF THE INVENTION", the following effects can be obtained.

(1) The number and positions of burner parts, which are combusted, is/are selected according to a request for combusting an air-fuel mixture, and effective combustion of an air-fuel mixture can be obtained.

(2) High intensity combustion is generated adjacent to low intensity combustion, or high intensity combustion is generated while surrounded by low intensity combustion. Thus, the flame holding function by low intensity combustion can be obtained. This flame holding function prevents flames from lifting-off, and stable high intensity combustion can be achieved.

(3) Stable high intensity combustion is maintained with the flame holding function by low intensity combustion, and the thermal efficiency can be prevented from decreasing due to lifting-off.

(4) High intensity combustion is maintained with the flame holding function by low intensity combustion, and excess CO emission due to lifting-off etc. can be held down.

(5) An air-fuel mixture of good quality is generated by fuel gas and air that are taken in, high intensity combustion and low intensity combustion can be obtained, and the efficiency of combustion can be improved.

Technical ideas extracted from the embodiments including the example described above will then be listed. The technical ideas of the present disclosure may be comprehended at various levels and variations ranging from higher to lower conceptions and the present disclosure is not limited to the following description.

A burner includes an air-fuel mixture outlet member that includes a single or a plurality of outlet(s) out of which an air-fuel mixture flows; and a metal fiber knitting body that covers the air-fuel mixture outlet member, wherein the air-fuel mixture, which is made to flow out of the outlet(s), passes through the metal fiber knitting body and is combusted, a flame of low intensity is generated together with a flame of high intensity by combustion of the air-fuel mixture, and the flame of low intensity holds the flame of high intensity.

Preferably, the above burner further includes a mixing unit that is in a back side of the air-fuel mixture outlet member, and that mixes fuel gas and air to generate the air-fuel mixture, wherein the air-fuel mixture is made to flow from the mixing unit to the air-fuel mixture outlet member.

Preferably, in the above burner, the air-fuel mixture outlet member and the metal fiber knitting body generate an area of the flame of high intensity and an area of the flame of low intensity on a combustion field for the air-fuel mixture.

A combustion apparatus includes a burner; a single or a plurality of mixing chamber(s) that mix(es) fuel gas and air to generate an air-fuel mixture; and a single or a plurality of fixing unit(s) that disperse(s) the air-fuel mixture, which is obtained in the mixing chamber(s), to make the air-fuel mixture flow to the burner.

Preferably, in the above combustion apparatus, the burner includes an air-fuel mixture outlet member that includes a single or a plurality of outlet(s) out of which the air-fuel mixture flows, and a metal fiber knitting body that covers the air-fuel mixture outlet member, and the air-fuel mixture, which is made to flow out of the outlet(s), passes through the metal fiber knitting body and is combusted, a flame of low intensity is generated together with a flame of high intensity by combustion of the air-fuel mixture, and the flame of low intensity holds the flame of high intensity.

Preferably, in the above combustion apparatus, the mixing chamber includes a flow changing part that changes a flow of the air-fuel mixture, and a separation plate that separates the fuel gas or the air, which is taken in to the mixing chamber, from the air-fuel mixture, the flow of which is changed by the flow changing part.

Preferably, in the above combustion apparatus, the fixing unit includes a first fixing plate that fixes a flow of the air-fuel mixture, which is obtained in the mixing chamber, and a second fixing plate that guides the air-fuel mixture, the flow of which is fixed by the first fixing plate, to the outlets of the burner(s).

A combustion apparatus includes a plurality of burner parts that carry out blue flame combustion; an air-fuel mixture supply unit that is disposed for the burner parts, and supplies an air-fuel mixture to the burner parts; and a control unit that selects, from the burner parts, a single or a plurality of burner part(s) that combust(s) the air-fuel mixture by switching the air-fuel mixture supply unit according to a requested amount of combustion of the air-fuel mixture, and that controls the combustion of the air-fuel mixture.

Preferably, in the above combustion apparatus, each of the burner parts includes an air-fuel mixture outlet member that includes a single or a plurality of outlet(s) out of which the air-fuel mixture flows, and a metal fiber knitting body that covers the air-fuel mixture outlet member, and the air-fuel mixture, which is made to flow out of the outlet(s), passes through the metal fiber knitting body and is combusted, a flame of low intensity is generated together with a flame of high intensity by combustion of the air-fuel mixture, and the flame of low intensity holds the flame of high intensity.

Preferably, in the above combustion apparatus, the control unit controls the number or (a) position(s) of the single or plurality of burner part(s) that combust(s) the air-fuel mixture.

Preferably, in the above combustion apparatus, the air-fuel mixture supply unit includes a flow changing part that changes a flow of the air-fuel mixture, and a separation plate that separates fuel gas or air that is taken in to the air-fuel mixture supply unit, from the air-fuel mixture, the flow of which is changed by the flow changing part.

Preferably, in the above combustion apparatus, the air-fuel mixture supply unit includes a first fixing plate that fixes a flow of the air-fuel mixture, and a second fixing plate that guides the air-fuel mixture, the flow of which is fixed by the first fixing plate, to the outlets of the burner parts.

A method for combustion includes making an air-fuel mixture flow out of a single or a plurality of outlet(s) that an air-fuel mixture outlet member includes; and passing the air-fuel mixture through a metal fiber knitting body that is disposed while covering the air-fuel mixture outlet member, combusting the air-fuel mixture, generating a flame of high intensity and a flame of low intensity by combustion of the air-fuel mixture, and holding the flame of high intensity by the flame of high intensity.

A method for combustion includes disposing a single or a plurality of mixing chamber(s) that mix(es) fuel gas and air are to generate an air-fuel mixture for a burner, and dispersing the air-fuel mixture, which is obtained in the mixing chamber(s), by a single of a plurality of fixing unit(s) to make the air-fuel mixture flow to the burner; making the air-fuel mixture flow out of the burner; and generating a flame of high intensity and a flame of low intensity on the burner and holding the flame of high intensity by the flame of low intensity.

A method for controlling combustion of an air-fuel mixture includes selecting a single or a plurality of burner part(s) that combust(s) an air-fuel mixture, from a plurality of burner parts that carry out blue flame combustion by switching an air-fuel mixture supply unit that supplies the air-fuel mixture to the burner parts according to a requested amount of combustion of the air-fuel mixture, and controlling the combustion of the air-fuel mixture.

A non-transitory computer readable recording medium having stored therein a program for causing a computer to execute a process for controlling combustion, the process includes selecting a single or a plurality of burner part(s) that combust(s) an air-fuel mixture, from a plurality of burner parts that carry out blue flame combustion by switching an air-fuel mixture supply unit that supplies the air-fuel mixture to the burner parts according to a requested amount of combustion of the air-fuel mixture, and controlling the combustion of the air-fuel mixture.

A water heater includes a burner that includes an air-fuel mixture outlet member including a single or a plurality of outlet(s) out of which an air-fuel mixture flows, and a metal fiber knitting body covering the air-fuel mixture outlet member, wherein the air-fuel mixture, which is made to flow out of the outlet(s), passes through the metal fiber knitting body and is combusted, a flame of low intensity is generated together with a flame of high intensity by combustion of the air-fuel mixture, and the flame of low intensity holds the flame of high intensity.

A water heater that uses a combustion apparatus combusting fuel gas as a heat source includes a burner; a single or a plurality of mixing chamber(s) that mix(es) fuel gas and air to generate an air-fuel mixture; and a single of a plurality of fixing unit(s) that disperse(s) the air-fuel mixture, which is obtained in the mixing chamber(s), to make the air-fuel mixture flow to the burner.

A water heater that uses a combustion apparatus combusting fuel gas as a heat source includes a plurality of burner parts that carry out blue flame combustion; an air-fuel mixture supply unit that is disposed for a plurality of the burner parts, and supplies an air-fuel mixture to a plurality of the burner parts; and a control unit that selects, from the burner parts, a single or a plurality of burner part(s) that combust(s) the air-fuel mixture by switching the air-fuel mixture supply unit according to a requested amount of combustion of the air-fuel mixture, and controls the combustion of the air-fuel mixture.

In the disclosed embodiments, the processing can be accomplished by a computer-executable program, and this program can be realized in a computer-readable memory device.

In the embodiments, the memory device, such as a magnetic disc, a flexible disk, a hard disk, an optical disk (CD-ROM, CD-R, DVD, and so on), an optical magnetic disk (MD and so on) can be used to store instructions for causing a processor or a computer to perform the processes described above.

Furthermore, based on an indication of the program installed from the memory device to the computer, OS (operation system) operating on the computer, or MW (middle ware software), such as database management software or network, may execute one part of each processing to realize the embodiments.

Furthermore, the memory device is not limited to a device independent from the computer. By downloading a program transmitted through a LAN or the Internet, a memory device in which the program is stored is included. Furthermore, the memory device is not limited to one. In the case that the processing of the embodiments is executed by a plurality of memory devices, a plurality of memory devises may be included in the memory device. The component of the device may be arbitrarily composed.

A computer may execute each processing state of the embodiments according to the program stored in the memory device. The computer may be one apparatus such as a personal computer or a system in which a plurality of processing apparatuses are connected through a network. Furthermore, the computer is not limited to a personal computer. Those skilled in the art will appreciate that a computer includes a processing unit in an information processor, a microcomputer, and so on. In short, the equipment and the apparatus that can execute the functions in embodiments using the program are generally called the computer.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

According to the burner, the combustion apparatus, the method for combustion, the method for controlling combustion, the recording medium and the water heater of this invention, blue flame combustion can be maintained through holding flames by red heat combustion. Thus, the present invention is useful because the high efficiency, making the size small, and moreover, combustion of high safety can be obtained. Burner part(s), which is/are to be combusted, is/are selected out of a plurality of burner parts, and the position(s) of burner part(s), which is/are to be combusted, is/are controlled according to the requested amount of combustion of an air-fuel mixture, and effective combustion of an air-fuel mixture can be obtained.

What is claimed is:

1. A burner, comprising:

an air-fuel mixture outlet member that includes a plurality of outlets out of which an air-fuel mixture flows, the plurality of outlets being divided into a plurality of areas and being arranged as a matrix, and a closed part that blocks an outflow of the air-fuel mixture, the closed part surrounding the plurality of areas of the plurality of outlets; and a metal fiber knitting body that covers the air-fuel mixture outlet member, wherein the metal fiber knitting body has a thickness such that a part of the air-fuel mixture flows into a portion of the metal fiber knitting body which is disposed over the closed part of the air-fuel mixture outlet member, and the metal fiber knitting body diffuses the air-fuel mixture, which is made to flow out of the outlets, such that a first flow of the air-fuel mixture passes through a center of each of the plurality of outlets and a second flow of the air-fuel mixture passes through a side of each of the plurality of outlets such that the second flow of the air-fuel mixture flows into the portion of the metal fiber knitting body which is disposed over the closed part, wherein the burner is configured such that combusting the air-fuel mixture heats the metal fiber knitting body, generates a flame of high intensity combustion from the first flow of the air-fuel mixture, and generates a flame of low intensity combustion from the second flow of the air-fuel mixture on a surface of the portion of the metal fiber knitting body which is disposed over the closed part, wherein the flame of low intensity combustion holds the flame of high intensity combustion, wherein each of the plurality of areas comprises a plurality of outlets spaced from each other in a first direction, a distance between adjacent outlet areas in the first direction being greater than a distance between adjacent outlets within each outlet area in the first direction, wherein no outlets are present along the distance between adjacent outlet areas to form the closed part, and wherein the burner further comprises a division wall on the closed part, the division wall dividing a mixing unit disposed on a back side of the air-fuel mixture outlet member.

2. The burner of claim 1, wherein the mixing unit mixes fuel gas and air to generate the air-fuel mixture, and wherein the air-fuel mixture flows from the mixing unit to the air-fuel mixture outlet member.

3. The burner of claim 1, wherein the air-fuel mixture outlet member and the metal fiber knitting body provide an area of the flame of high intensity combustion and an area of the flame of low intensity combustion on a combustion field for the air-fuel mixture.

4. The burner of claim 1, wherein the plurality of areas comprises a first outlet area including a row of two outlets, and a second outlet area including a row of three outlets.

5. The burner of claim 1, wherein the air-fuel mixture outlet member and the metal fiber knitting body are both curved.

6. The burner of claim 1, wherein the thickness of the metal fiber knitting body is two-fold thicker than that of the air-fuel mixture outlet member.

7. A water heater, comprising:

a burner that includes an air-fuel mixture outlet member including a plurality of outlets and a closed part, and a metal fiber knitting body covering the air-fuel mixture outlet member, wherein an air-fuel mixture flows out of the plurality of outlets, and the plurality of outlets are divided into a plurality of areas and are arranged as a matrix, wherein the closed part blocks an outflow of the air-fuel mixture, and surrounds the plurality of areas of the plurality of outlets, wherein the metal fiber knitting body has a thickness such that a part of the air-fuel mixture flows into a portion of the metal fiber knitting body which is disposed over the closed part of the air-fuel mixture outlet member, and the metal fiber knitting body diffuses the air-fuel mixture, which is made to flow out of the outlets, such that a first flow of the air-fuel mixture passes through a center of each of the plurality of outlets and a second flow of the air-fuel mixture passes through a side of each of the plurality of outlets such that the second flow of the air-fuel mixture flows into the portion of the metal fiber knitting body which is disposed over the closed part, wherein the burner is configured such that combusting the air-fuel mixture heats the metal fiber knitting body, generates a flame of high intensity combustion from the first flow of the air-fuel mixture, and generates a flame of low intensity combustion from the second flow of the air-fuel mixture on a surface of the portion of the metal fiber knitting body which is disposed over the closed part, wherein the flame of low intensity combustion holds the flame of high intensity combustion, wherein each of the plurality of areas comprises a plurality of outlets spaced from each other in a first direction, a distance between adjacent outlet areas in the first direction being greater than a distance between adjacent outlets within each outlet area in the first direction, wherein no outlets are present along the distance between adjacent outlet areas to form the closed part, and wherein the burner further comprises a division wall on the closed part, the division wall dividing a mixing unit disposed on a back side of the air-fuel mixture outlet member.

* * * * *